US005871052A

United States Patent [19]

Benson et al.

[11] Patent Number: 5,871,052

[45] Date of Patent: Feb. 16, 1999

[54] APPARATUS AND METHOD FOR DOWNHOLE TOOL DEPLOYMENT WITH MUD PUMPING TECHNIQUES

[75] Inventors: Walter R. Benson, Houston; Augdon J. Sampa, Stafford, both of Tex.

[73] Assignee: Schlumberger Technology Corporation, Houston, Tex.

[21] Appl. No.: 870,079

[22] Filed: Jun. 5, 1997

Related U.S. Application Data

[60] Provisional application No. 60/038,110 Feb. 19, 1997.

[51] Int. Cl.[6] ..... E21B 23/08

[52] U.S. Cl. ..... 166/386; 166/153

[58] Field of Search ..... 166/383, 386, 166/250.01, 250.11, 125, 220, 153, 154, 155

[56] References Cited

U.S. PATENT DOCUMENTS

| | | | |
|---|---|---|---|
| 3,727,693 | 4/1973 | Tausch et al. | 166/383 |
| 3,957,119 | 5/1976 | Yonker | 166/383 |
| 4,457,369 | 7/1984 | Henderson | 166/125 |
| 4,484,628 | 11/1984 | Lanmon, II | 166/250.01 |
| 4,943,172 | 7/1990 | Waldrep | 166/220 X |
| 5,163,515 | 11/1992 | Tailby et al. | 166/383 |
| 5,180,009 | 1/1993 | Sneed | 166/155 |
| 5,209,304 | 5/1993 | Nice | 166/383 |
| 5,284,208 | 2/1994 | Clemens et al. | 166/383 |

*Primary Examiner*—Frank Tsay

*Attorney, Agent, or Firm*—John J. Ryberg; Brigitte L. Jeffery

[57] ABSTRACT

A bulkhead adaptor for use with a downhole tool to be pumped through a well casing or drill pipe on a cable. The bulkhead adaptor includes a housing assembly having an upper attachment element for connecting the housing assembly to the cable, and a lower attachment element for connecting the housing to the tool. The adaptor also has a circular swab cup defining a surface area exposed to a flow of pumping fluid. The swab cup is removably attached to the housing and has an outer diameter enclosing a projected area greater than the projected area of the tool, measured in a plane transverse to said well casing or drill pipe. Various preferred materials and methods of use are disclosed. The invention can especially improve the pumping of tools down horizontal or highly deviated wells.

26 Claims, 17 Drawing Sheets

-1
188
189
170
152
156
182
154
156
168
165
150
166
158
180

-2
7D
7D
163
162
166
180
158
164
176
150
186
174
160
175
172
178

FIG. 10
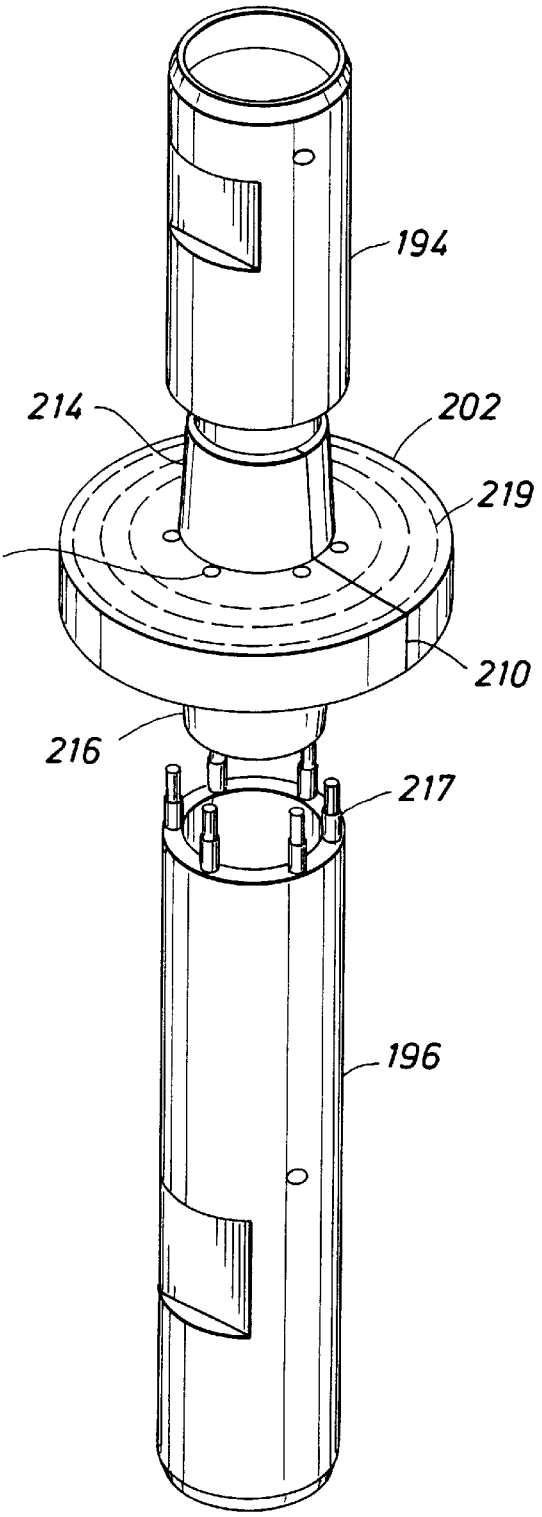
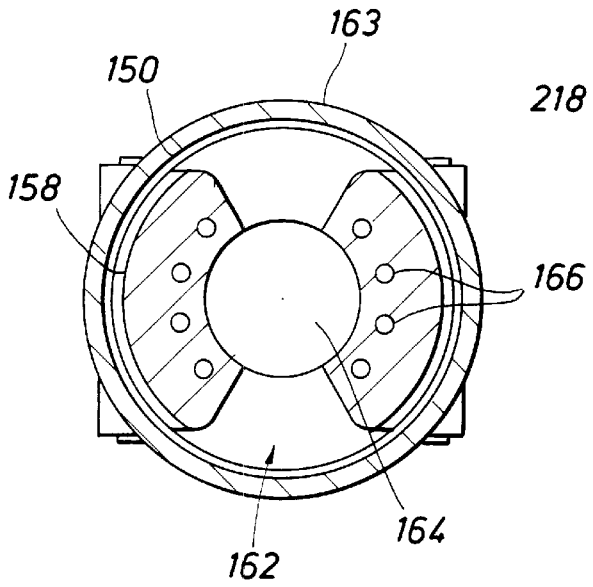
FIG. 7D

FIG. 9
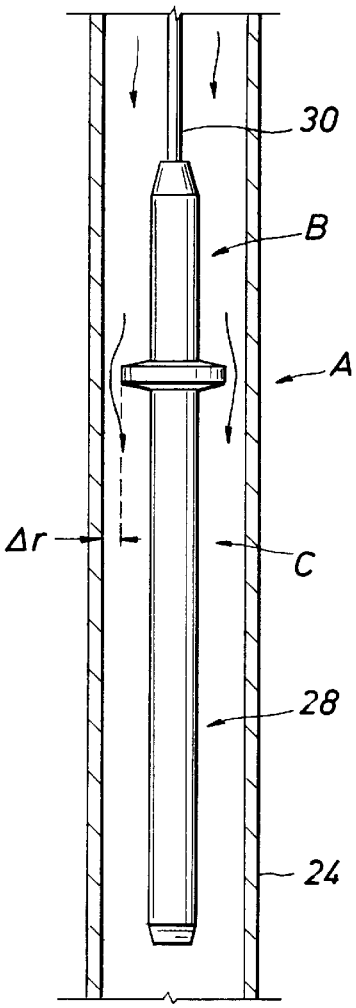
FIG. 9A
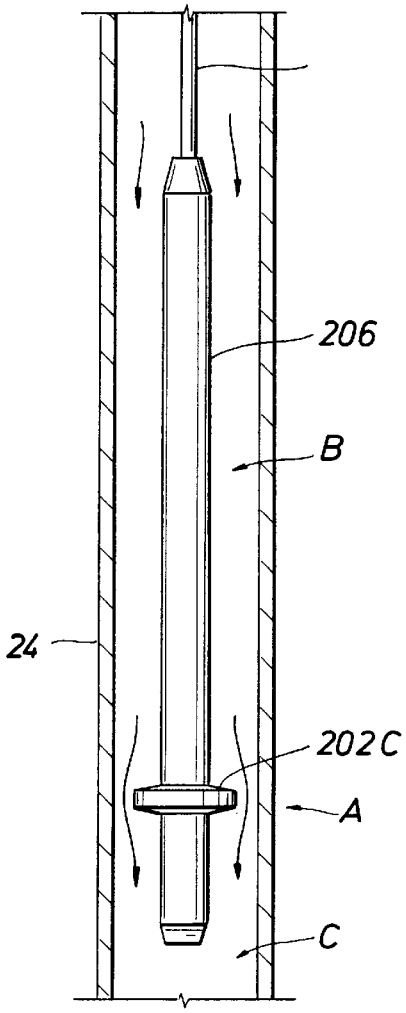
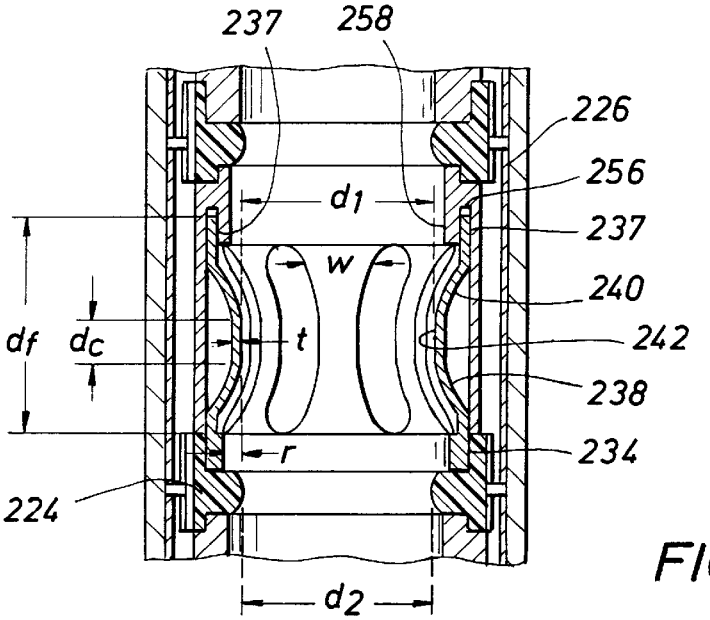
FIG. 13

FIG. 11
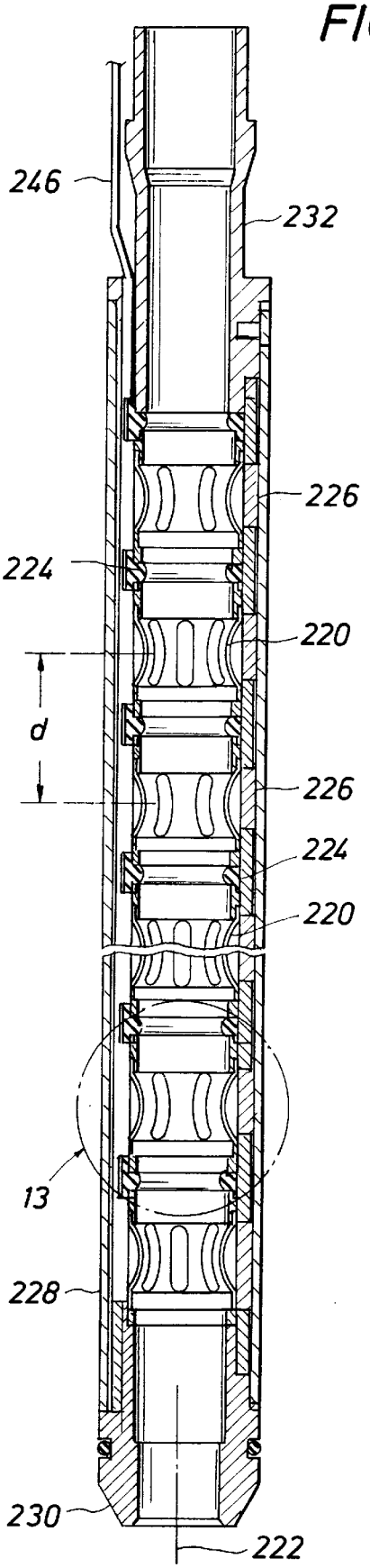
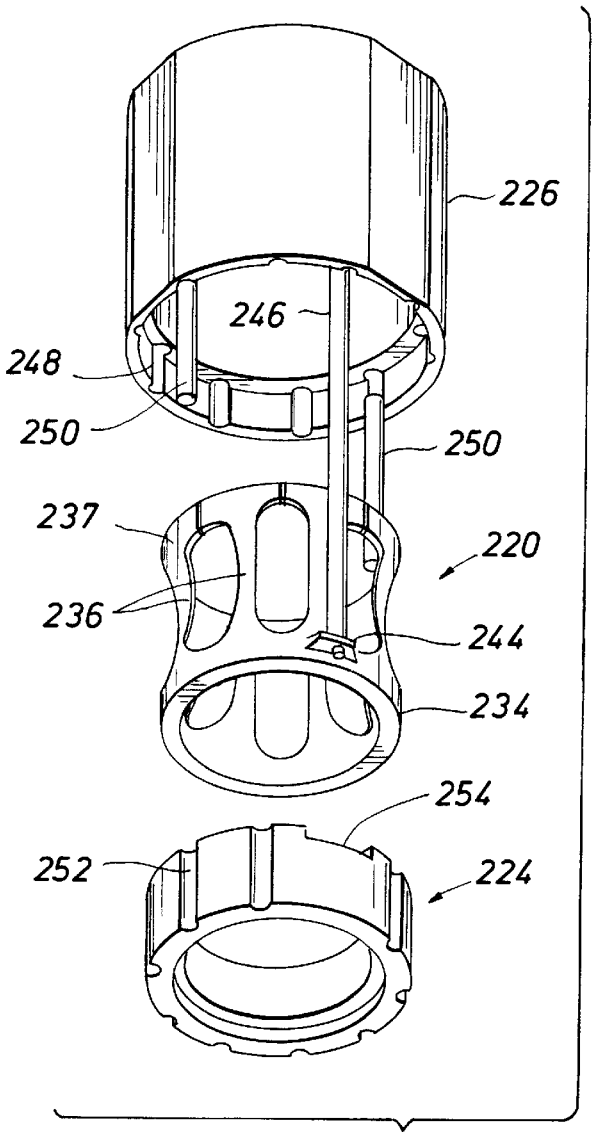
FIG. 12

APPARATUS AND METHOD FOR DOWNHOLE TOOL DEPLOYMENT WITH MUD PUMPING TECHNIQUES

This present application claims the benefit of U.S. Provisional Application No. 60/038,110 filed Feb. 19, 1997 (attorney docket number 25.170).

BACKGROUND OF THE INVENTION

This invention relates to an apparatus and method for deploying tools in oil wells with mud pumping techniques, and has special application for use in highly deviated wells.

Once an oil well is drilled, it is common to log certain sections of the well with electrical instruments. These instruments are sometimes referred to as "wireline" instruments, as they communicate with the logging unit at the surface of the well through an electrical wire or cable with which they are deployed. In vertical wells, often the instruments are simply lowered down the well on the logging cable. In horizontal or highly deviated wells, however, gravity is frequently insufficient to move the instruments to the depths to be logged. In these situations, it is sometimes necessary to push the instruments along the well with drill pipe.

Wireline logging with drill pipe can be difficult, however, because of the presence of the cable. It is cumbersome and dangerous to pre-string the electrical cable through all of the drill pipe before lowering the instruments into the well. Some deployment systems have therefore been developed, such as Schlumberger's Tough Logging Conditions System (TLCS), that make the electrical connection between the instruments and the cable down hole, after the instruments have been lowered to depth. In these systems, the electrical instruments are easily deployed with standard drill pipe, and the cable is then run down the inside of the drill pipe and connected. After logging, the cable can be easily detached from the logging tool and removed before the tool is retrieved. The TLCS has been very effective and has achieved strong commercial acceptance.

In the TLCS and other systems, the cable is remotely connected to the instrumentation with a down hole connector. One half portion of this connector is attached to the instrumentation and lowered into the well on drill pipe. The other half portion of the connector is attached to the end of the cable and pumped down the drill pipe with a flow of mud that circulates out of open holes at the bottom of the drill pipe and into the well bore. The connector is sometimes referred to as a "wet connector" because the connection is made in the flow of drilling mud under conditions that challenge electrical connection reliability. In highly deviated or horizontal wells, pumping the connector down the well can be especially challenging. In such cases the pumping force exerted on the connector must overcome friction between the well casing or drill pipe surface, and in some instances must even act against gravity.

The challenge of pumping the cable connector down the well applies to pumping any wireline tool down a well with a flow of drilling muds, which can, depending on the application and down hole environment, have a wide range of weights and viscosities.

SUMMARY OF THE INVENTION

We have discovered that, by providing the cable connector (or other tool to be pumped down a well) with an appropriately constructed bulkhead adaptor with a swab cup, a down hole flow restriction can be successfully achieved that can substantially improve the pumping of the connector or tool along the well, especially in highly deviated wells.

According to one aspect of the invention, a bulkhead adaptor is provided for use with a downhole tool to be pumped through a well casing or drill pipe on a cable. The bulkhead adaptor includes a housing assembly having an upper attachment element for connecting the housing assembly to the cable, and a lower attachment element for connecting the housing to the tool. The adaptor also has a circular swab cup defining a surface area exposed to a flow of pumping fluid. The swab cup is removably attached to the housing and has an outer diameter enclosing a projected area greater than the projected area of the tool, measured in a plane transverse to said well casing or drill pipe.

In some presently preferred embodiments, the swab cup comprises a resilient material, such as a fluorocarbon elastomer.

In some other embodiments, the swab cup comprises a material selected from the group consisting of aluminum, brass, polytetrafluoroethylene and acetal resin. The most preferable of these materials, at present, is acetal homopolymer resin.

In some constructions, the housing assembly includes a lower housing section, and an upper housing section. The upper housing section is constructed for releasable attachment to the lower housing section, with the swab cup retained therebetween. The swab cup preferably comprises a resilient material compressed between the upper and lower housing sections.

The housing also includes, in some cases, a swab cup retainer pin extending between the upper and lower housing sections, through the swab cup.

In some instances, the lower housing section includes a lower body defining a shoulder and having a shaft extending from the shoulder through the swab cup, the shaft having a threaded end portion, and a lower swab cup retainer sleeve rotatably disposed about the shaft between the shoulder and the swab cup. The upper housing section includes a nut with threads for engaging the threaded end portion of the shaft in a manner to compress the swab cup, and an upper swab cup retainer sleeve rotatably disposed about the shaft between the nut and the swab cup.

In some preferred arrangements, at least one of the upper and lower housing sections defines an inner bore axially overlapping an outer surface of the swab cup in a manner to retain the swab cup. For some applications, the inner bore defines a frustoconical surface with a taper angle, measured with respect to the axis of the swab cup, of between about 5 and 10 degrees.

In some embodiments the swab cup comprises an injection-molded material. In some cases, the swab cup defines concentric, molded trim guides indicating trimming diameters for adapting the swab cup for use in different well casing or drill pipe diameters.

In some embodiments, the housing defines an inner bore for extending the cable through the adaptor for electrical connection to the tool.

The upper attachment includes, in some embodiments, a grommet for sealing between the cable and the housing, and a grommet nut for compressing the grommet about the cable. In some cases, the grommet defines a slit extending through one side of the grommet, such that the grommet is replaceable without separating the cable from the housing.

In another aspect of the invention, the abovedescribed adaptor is combined with a well logging tool attached to the lower attachment of the adaptor housing.

In another aspect of the invention, a downhole tool is provided, to be pumped through a well casing or drill pipe on a cable. The downhole tool includes a circular swab cup attached to the tool near its lower end. The swab cup defines a surface area exposed to a flow of pumping fluid, and is removably attached to the tool. The swab cup has an outer diameter enclosing a projected area greater than the projected area of the tool, measured in a plane transverse to the well casing or drill pipe.

The above-described features are combined, in various embodiments, as required to satisfy the needs of a given application.

According to another aspect of the invention, a method of pumping a tool through a well casing or drill pipe on a cable is provided. The method includes the steps of:

1. providing a swab cup adaptor having a housing assembly with an upper attachment element for connecting the housing assembly to the cable, and a lower attachment element for connecting the housing to the tool, and a circular swab cup defining a surface area exposed to a flow of pumping fluid (the swab cup being removably attached to the housing and having an outer diameter enclosing a projected area greater than the projected area of the tool, measured in a plane transverse to the well casing or drill pipe);
2. attaching the tool to the lower attachment of the swab cup adaptor;
3. attaching the cable to the upper attachment of the swab cup adaptor;
4. placing the tool and swab cup adaptor in the well casing or drill pipe; and
5. pumping fluid through the well casing to push the swab cup adaptor and the attached tool through the well casing or drill pipe.

In some embodiments, the method further includes the step of trimming the swab cup adaptor to a diameter appropriate to the diameter of the well casing or drill pipe. Preferably, the swab cup is trimmed to an outer diameter about 0.10 inch less than the diameter of the well casing or drill pipe.

BRIEF DESCRIPTION OF THE DRAWING

FIG. 7D is a cross-sectional view taken along line 7D—7D in FIG. 7B.

FIG. 9 illustrates a function of the swab cup in a pipe.

FIG. 9A shows a swab cup arranged at the lower end of a tool.

FIG. 10 is an enlarged, exploded view of the swab cup and related components.

FIG. 11 is an enlarged view of the female connector assembly of FIG. 7B.

FIG. 12 is an exploded perspective view of a sub-assembly of the female connector assembly of FIG. 11.

FIG. 13 is an enlarged view of area 13 in FIG. 11.

DESCRIPTION OF PREFERRED EMBODIMENTS

Figure 1:
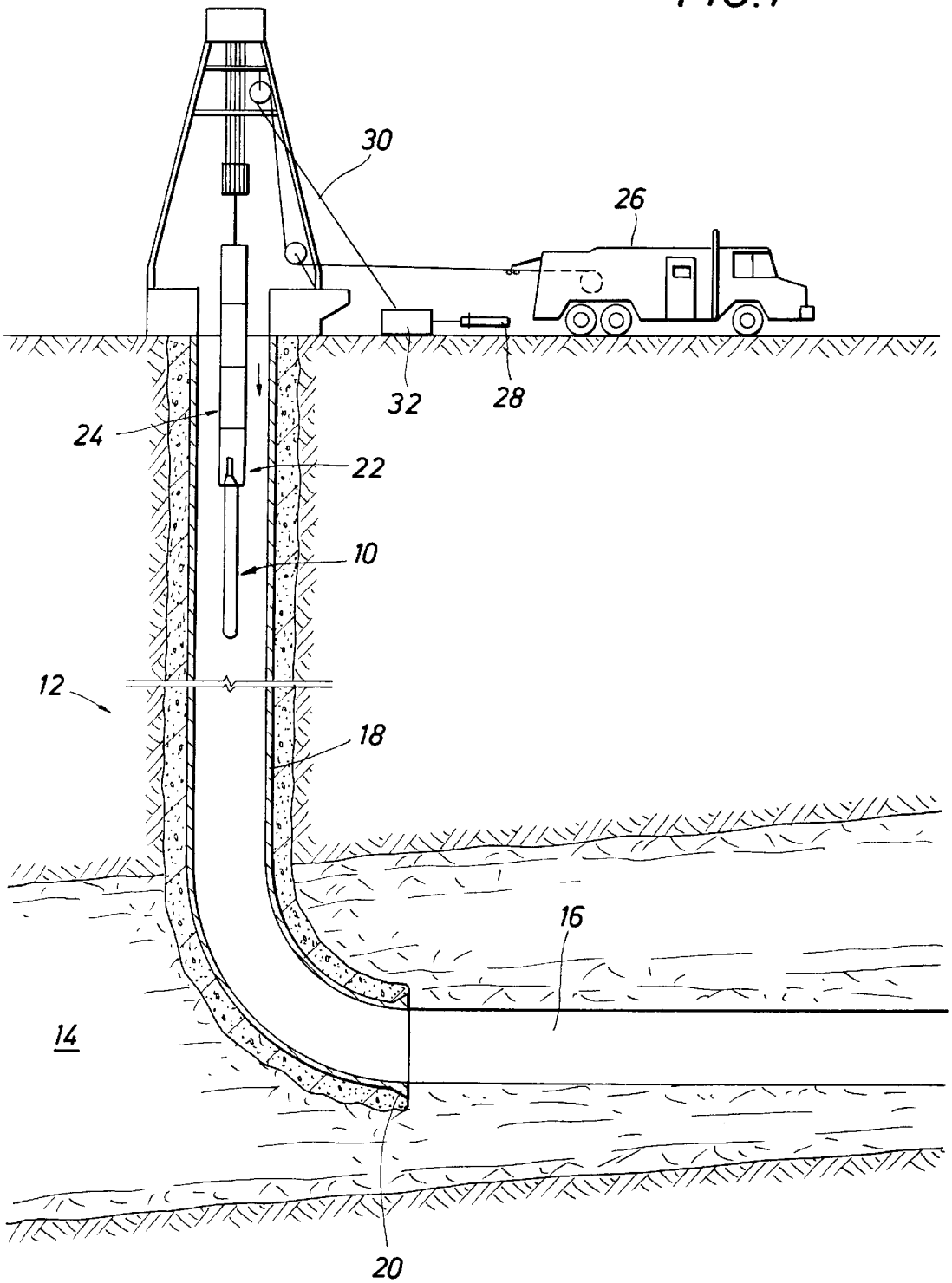
FIGS. 1–5 sequentially illustrate the use of a remotely-engaged electrical connector with a well logging tool.

Referring first to FIGS. 1 through 5, the downhole connection system is suitable for use with wireline logging tools 10 in either an open hole well or a cased well 12, and is especially useful in situations in which the well is deviated and/or the zone to be logged (e.g., zone 14) is at significant depth. In these figures, well 12 has a horizontal section 16 to be logged in zone 14, and is cased with a casing 18 that extends from the well surface down to a casing shoe 20.

As shown in FIG. 1, logging tools 10 are equipped with a down hole wet-connector head (DWCH) 22 that connects between an upper end of the logging tools and drill pipe 24. As will be more fully explained below, DWCH 22 provides a male part of a downhole electrical connection for electrical communication between logging tools 10 and a mobile logging unit 26. During the first step of the logging procedure, logging tools 10 and DWCH 22 are lowered into well 12 on connected lengths of standard drill pipe 24 until tools 10 reach the upper end of the section of well to be logged (e.g., the top of zone 14). Drill pipe 24 is lowered by standard techniques and, as the drill pipe is not open for fluid inflow from the well, at regular intervals (e.g., every 2000 to 3000 feet) the drill pipe is filled with drilling fluid (i.e., mud).

Figure 2:
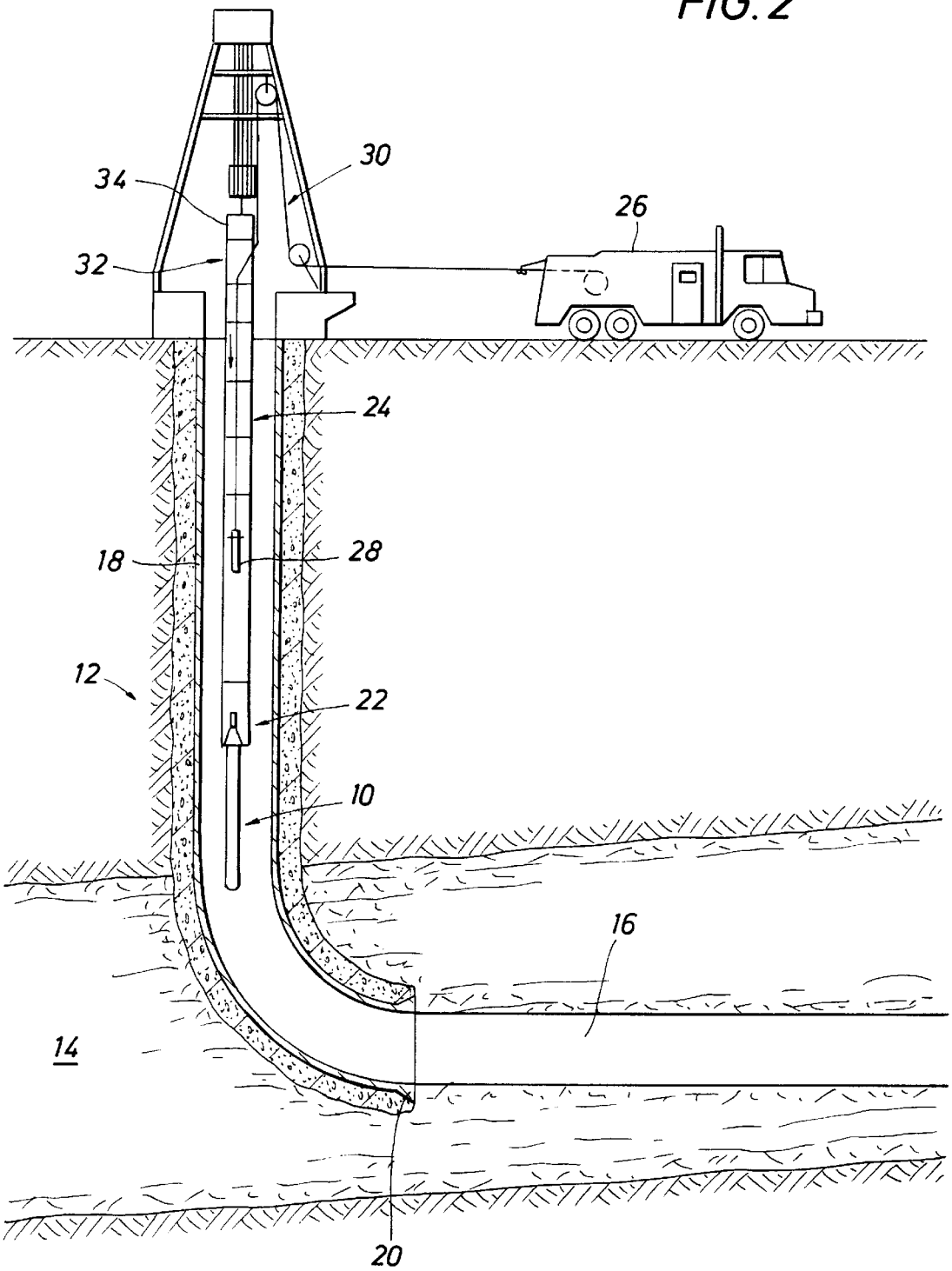

As shown in FIG. 2, when tools 10 have reached the top of zone 14, a pump-down wet-connector head (PWCH) 28 is lowered into the inner bore of the drill pipe on an electrical cable 30 that is reeled from logging unit 26. PWCH 28 has a female connector part to mate with the male connector part of the DWCH. A cable side-entry sub (CSES) 32, pre-threaded with cable 30 to provide a side exit of the cable from the made-up drill pipe, is attached to the upper end of drill pipe 24 and a mud cap 34 (e.g., of a rig top drive or Kelly mud circulation system) is attached above CSES 32 for pumping mud down the drill pipe bore. Standard mud pumping equipment (not shown) is used for this purpose. As will be discussed later, a specially constructed swab cup on the PWCH helps to develop a pressure force on PWCH 28, due to the flow of mud down the drill pipe, to push the PWCH down the well and to latch it onto DWCH 22 to form an electrical connection. A special valve (explained below) in DWCH 22 allows the mud flow to circulate from the drill pipe to the well bore.

Figure 3:
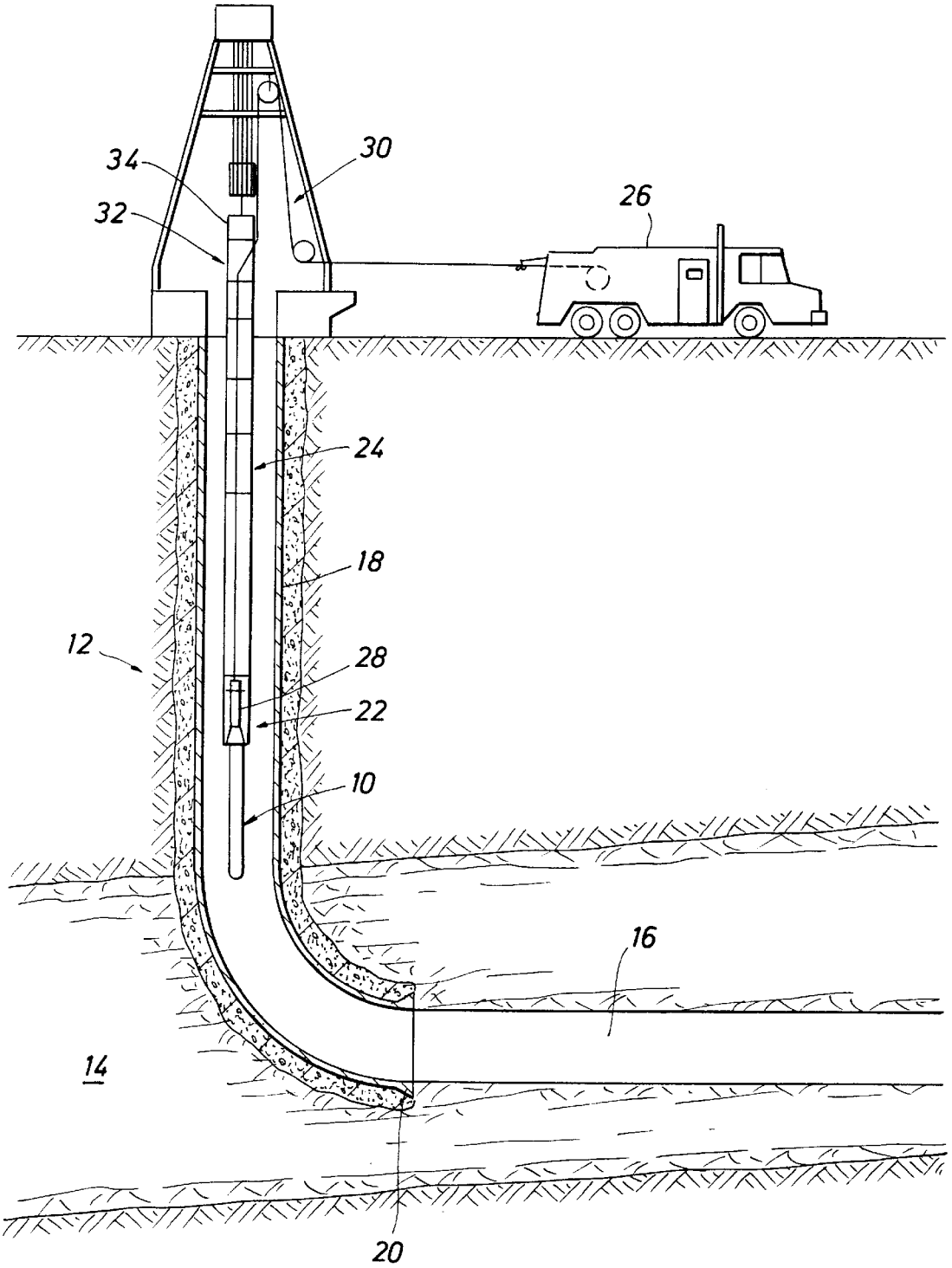

As shown in FIG. 3, PWCH 28 is pumped down drill pipe 24 until it latches with DWCH 22 to form an electrical connection between logging tools 10 and logging unit 26. At this point, the mud flow can be stopped and mud cap 34 removed from the top of the drill pipe. Logging tools 10 can be powered up to check system function or to perform a preliminary log as the logging tools are lowered to the bottom of the well.

Figure 4:
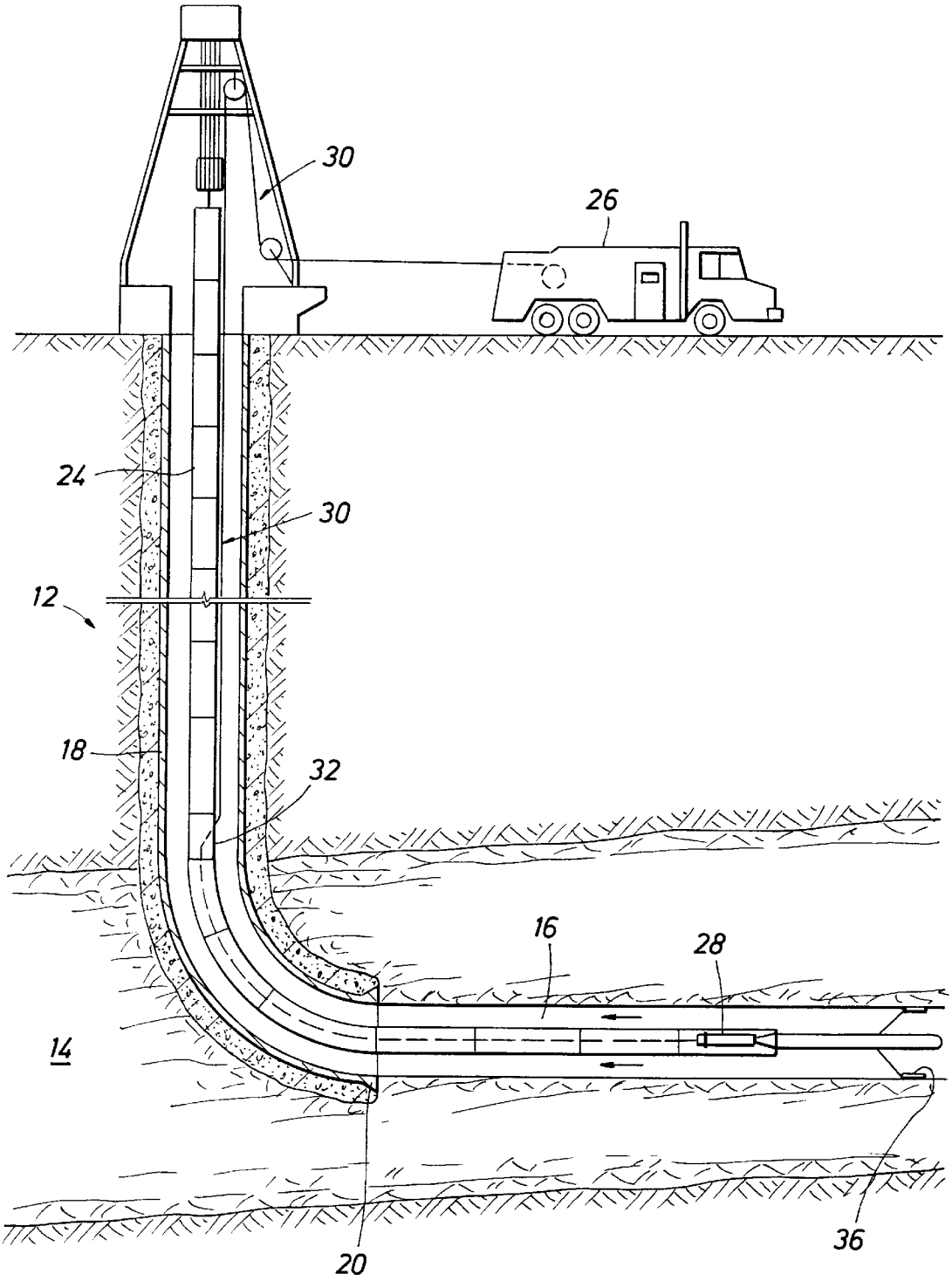

As shown in FIG. 4, logging tools 10, DWCH 22 and PWCH 28 are lowered or pushed down to the bottom of the well by standard drill pipe methods, adding additional sections of drill pipe 24 as required. During this process, CSES 32 remains attached to the drill pipe, providing a side exit for cable 30. Above CSES 32, cable 30 lies on the outside of drill pipe 24, avoiding the need to pre-string cable 30 through any sections of drill pipe other than CSES 32. The lowering process is coordinated between the logging unit operator and the drill pipe operator to lower the drill pipe and the cable simultaneously.

At the bottom of the well, the sensor fingers or pad devices 36 of the logging tool (if equipped) are deployed, and the logging tools are pulled back up the well to the top of zone 14 as the sensor readings are recorded in well logging unit 26. As during the lowering process, the raising of the logging tool is coordinated between the logging unit operator and the drill pipe operator such that the cable and the drill pipe are raised simultaneously.

Figure 5:
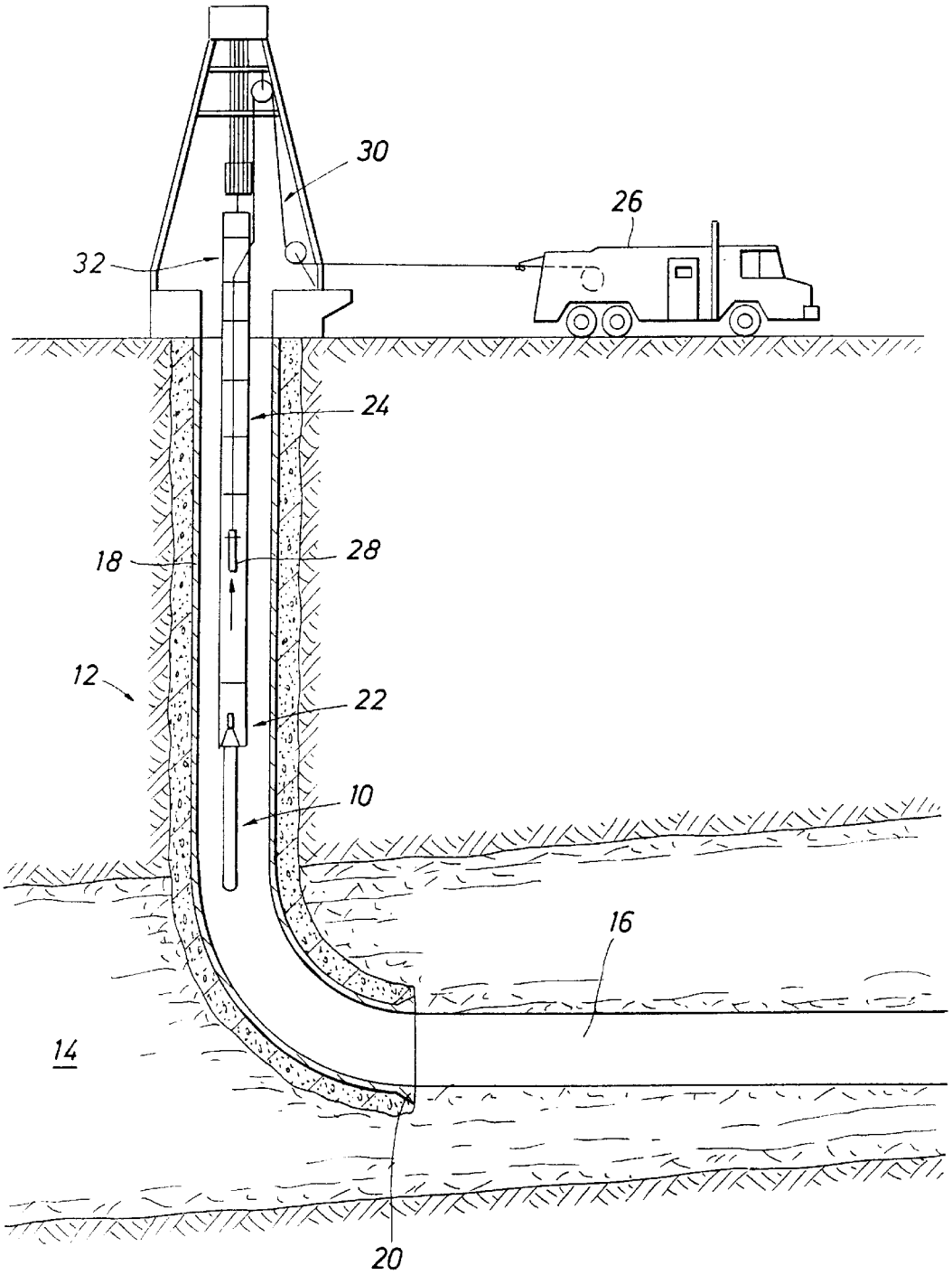

Referring to FIG. 5, after the logging is complete, the downhole power is turned off and PWCH 28 is detached from DWCH 22 and brought back up the well. CSES 32 and PWCH 28 are removed from the drill pipe and the rest of the drill pipe, including the DWCH and the logging tools, are retrieved.

Figures 1, 6A:
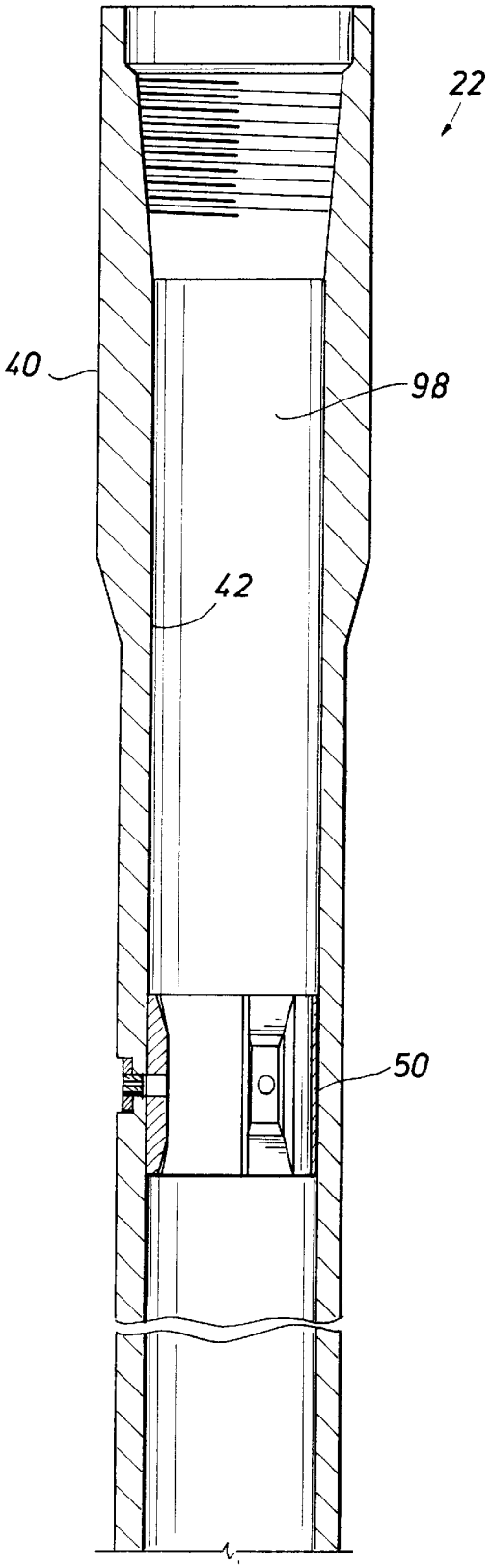
FIGS. 6A–6C illustrate the construction of the down hole half portion of the connector (the DWCH) of FIG. 1.
Figures 2, 6A:
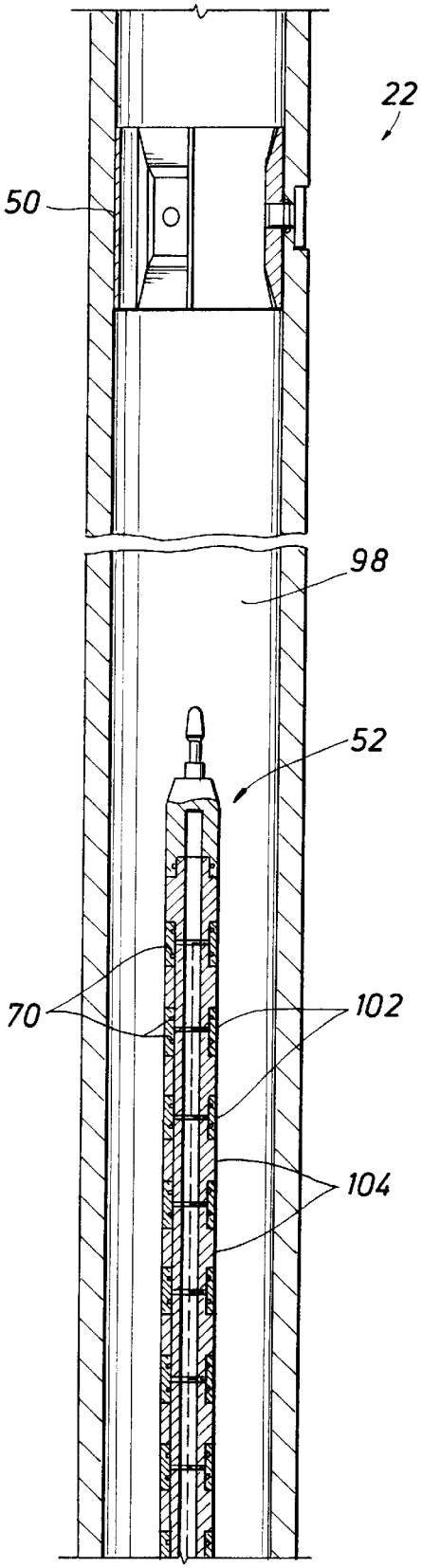
Figures 3, 6A:
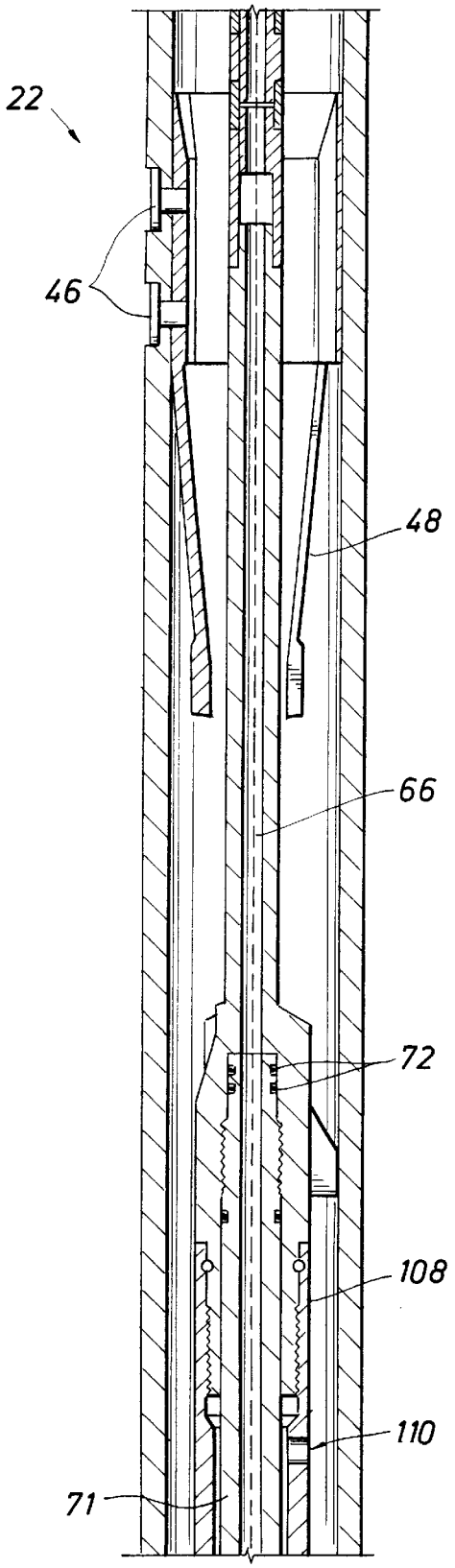
Figures 1, 6B:
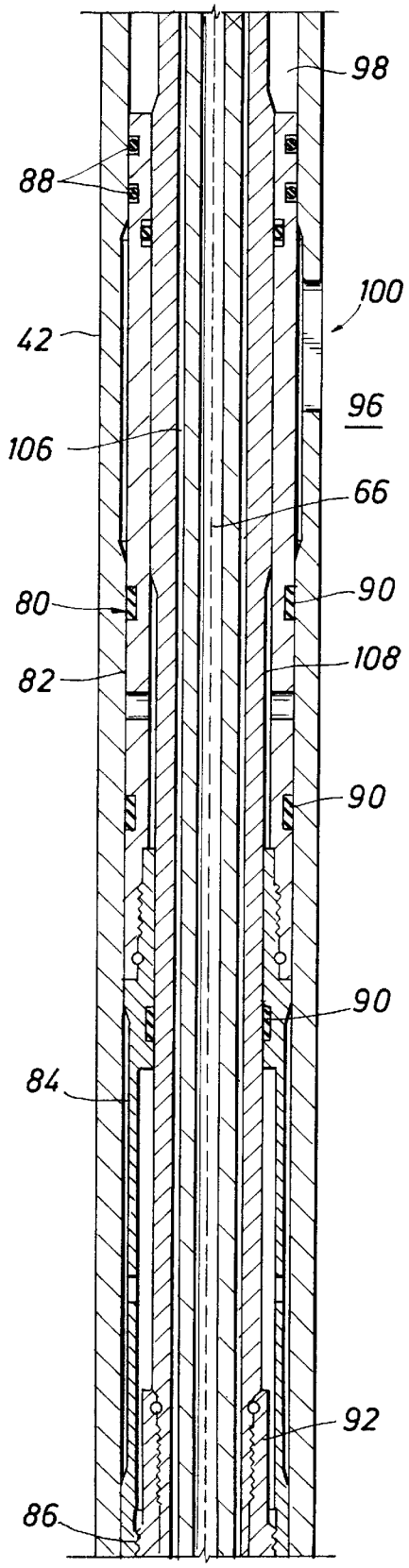
Figures 2, 6B:
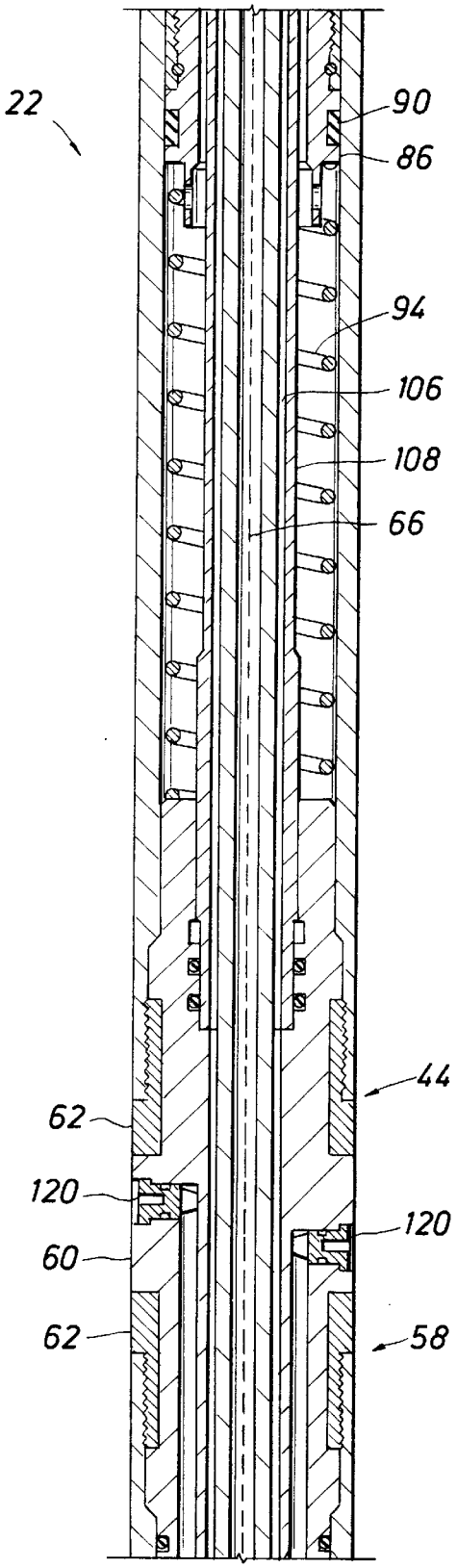
Figures 3, 6B:
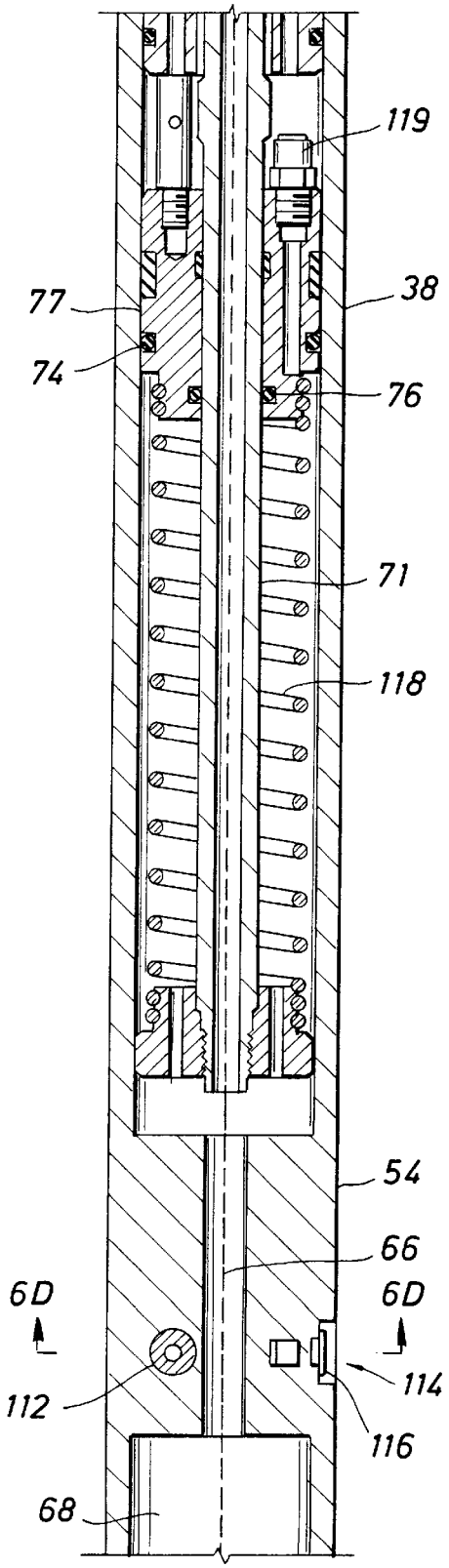
Figure 6C:
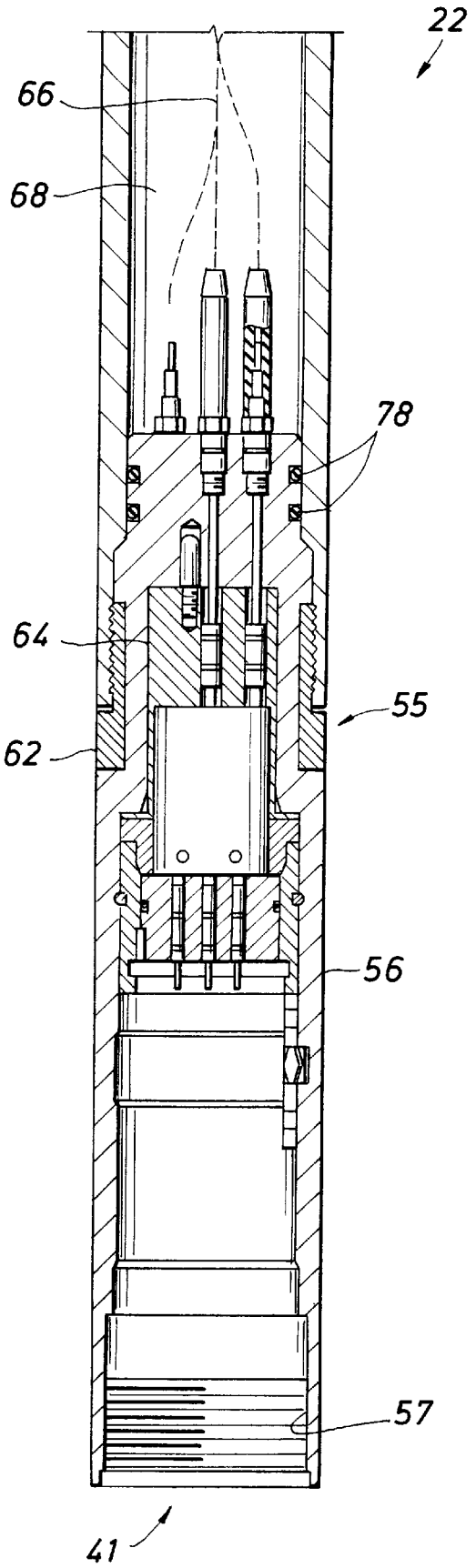

Referring to FIGS. 6A through 6C, DWCH 22 has two major subassemblies, the downhole wet-connector compensation cartridge (DWCC) 38 and the downhole wet-connector latch assembly (DWCL) 40. The lower end 41 of DWCC 38 connects to the logging tools 10 (see FIG. 1).

The DWCL 40 is the upper end of DWCH 22, and has an outer housing 42 which connects, at its lower end, to DWCC 38 at a threaded joint 44 (FIG. 6B). Attached to the inside surface of DWCL housing 42 with sealed, threaded fasteners 46 is a latch assembly which has three cantilevered latch fingers 48 extending radially inwardly and toward the DWCC for securing PWCH 28. Two axially separated centralizers 50 are also secured about the inside of DWCL housing 42 for guiding the lower end of the PWCH to mate with the male connector assembly 52 of the DWCC.

The DWCC 38 contains the electrical and hydraulic components of the DWCH. It has an outer housing 54 attached via a threaded joint 55 to a lower bulkhead assembly 56 having internal threads 57 at its lower end for releasably attaching the DWCH to logging tools. At the upper end of housing 54 is a threaded joint 58 joining housing 54 to a coupling 60. Split threaded sleeves 62 at joints 44, 55 and 58 enable the DWCH housing components 54, 60, 42 and 56 to be coupled without rotating either end of the DWCH. Bulkhead assembly 56 contains a sealed bulkhead electrical connector 64 for electrically connecting the DWCH to the logging tools.

One function of DWCC 38 is to provide exposed electrical contacts (in the form of male connector assembly 52) that are electrically coupled to the logging tools through bulkhead connector 64. This electrical coupling is provided through a multi-wire cable 66 that extends upward through a sealed wire chamber 68 to the individual contacts 102 of connector assembly 52. Cable 66 extends upward through an oil tube 71 through the center of the DWCH. Chamber 68 is sealed by individual o-ring contact seals 70 of connector assembly 52, o-ring seals 72 on oil tube 71, o-ring seals 74 and 76 on piston 77, and o-rings 78 on bulkhead assembly 56, and is filled with an electrically insulating fluid, such as silicone oil. The pressure in chamber 68 is maintained at approximately the pressure inside the drill pipe 24 (FIG. 1) near the top of DWCH 22 by the pressure compensation system described more fully below.

A mud piston assembly 80 (FIG. 6B), consisting of a piston 82, a piston collar 84, a piston stop 86, seals 88 and sliding friction reducers 90, is biased in an upward direction against piston stop nut 92 by a mud piston spring 94. With the mud piston assembly in the position shown, with stop 86 against nut 92, piston 82 effectively blocks fluid from moving between the well annulus 96 (the area between the drill pipe and the well bore; see FIG. 1) and the inside of the drill pipe (i.e., interior area 98) through three side ports 100 spaced about the diameter of the DWCH. In operation, mud piston assembly 80 remains in this port-blocking position until there is sufficient pressure in interior area 98 in excess of the pressure in well annulus 96 (acting against the upper end of piston 82) to overcome the biasing preload force of spring 94 and move the mud piston assembly downward, compressing spring 94 and exposing ports 100. Once exposed, ports 100 allows normal forward circulation of mud down the drill pipe and out through ports 100 into the well. Once mud pumping pressure is stopped, mud piston spring 94 forces mud piston assembly 80 back up to its port-blocking position. By blocking ports 100 in the DWCL housing 42 in the absence of mud pumping pressure in the drill pipe, mud piston assembly 80 effectively prevents undesirable inflow from the well into the drill pipe. This is especially useful in avoiding a well blow out through the drill pipe, and in keeping mud-carried debris from the well from interfering with proper function of the latching and electrical portions of the system. It also helps to prevent "u-tubing", in which a sudden inrush of well fluids and the resultant upward flow of mud in the drill pipe can cause the DWCH and PWCH to separate prematurely.

Male connector assembly 52 is made up of a series of nine contact rings 102, each sealed by two o-ring seals 70 and separated by insulators 104. The interior of this assembly of contact rings and insulators is at the pressure of chamber 68, while the exterior of this assembly is exposed to drill pipe pressure (i.e., the pressure of interior area 98). In order to maintain the structural integrity of this connector assembly, as well as the reliability of seals 70, it is important that the pressure difference across the connector assembly (i.e., the difference between the pressure in chamber 68 and the pressure in area 98) be kept low. Too great of a pressure difference (e.g., over 100 psi) can cause seals 70 to fail or, in extreme cases, for the connector assembly to collapse. Even minor leakage of electrically conductive drilling mud through seals 70 into chamber 68, due in part to a large difference between drill pipe pressure and the pressure in chamber 68, can affect the reliability of the electrical systems.

The pressure compensation system maintains the pressure differential across the male connector assembly within a reasonable level, and biases the pressure difference such that the pressure in chamber 68 is slightly greater (up to 50 to 100 psi greater) than the pressure in area 98. This "over-compensation" of the pressure in chamber 68 causes any tendency toward leakage to result in non-conductive silicone oil from chamber 68 seeping out into area 98, rather than conductive drilling muds flowing into chamber 68. An annulus 106 about oil tube 71, formed in part between oil tube 71 and a mud shaft 108 concentrically surrounding oil tube 71, conveys drilling mud pressure from area 98, through holes 110, to act against the upper side of piston 77. The mud pressure is transferred through piston 77, sealed by o-ring seals 74 and 76, into oil chamber 68.

Figure 6D:
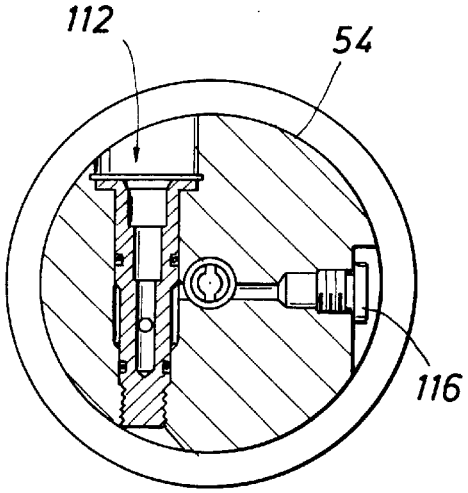
FIG. 6D is a cross-sectional view taken along line 6D—6D in FIG. 6B.

During assembly of the DWCC, oil chamber 68 is filled with an electrically insulative fluid, such as silicone oil, through a one-way oil fill check valve 112 (FIG. 6D), such as a Lee brand check valve CKFA1876015A. To properly fill the oil chamber, a vacuum is first applied to the chamber through a bleed port 114. With the vacuum applied, oil is back filled into chamber 68 through bleed port 114. This is repeated a few times until the chamber has been completely filled. Then the vacuum is removed, port 114 is sealed with a plug 116, and more oil is pumped into chamber 68 through check valve 112, extending a compensation spring 118, until a one-way pressure-limiting check valve 119 in piston 77 opens, indicating that the pressure in chamber 68 has reached a desired level above the pressure in chamber 98 (which, during this filling process, is generally at atmospheric pressure). When valve 119 indicates that the desired pressure is reached (preferably 50 to 100 psi, typically), the oil filling line is removed from one-way check valve 112, leaving chamber 68 pressurized.

Mud chamber fill ports 120 in coupling 60 allow mud annulus 106 and the internal volume above piston 77 to be pre-filled with a recommended lubricating fluid, such as motor oil, prior to field use. The lubricating fluid typically remains in the DWCH (specifically in annulus 106 and the volume above piston 77) during use in the well and is not readily displaced by the drilling mud, thereby simplifying tool maintenance. In addition to the lubricating fluid, generous application of a friction-reducing material, such as LUBRIPLATE™, is recommended for all sliding contact surfaces.

Figures 1, 7A:
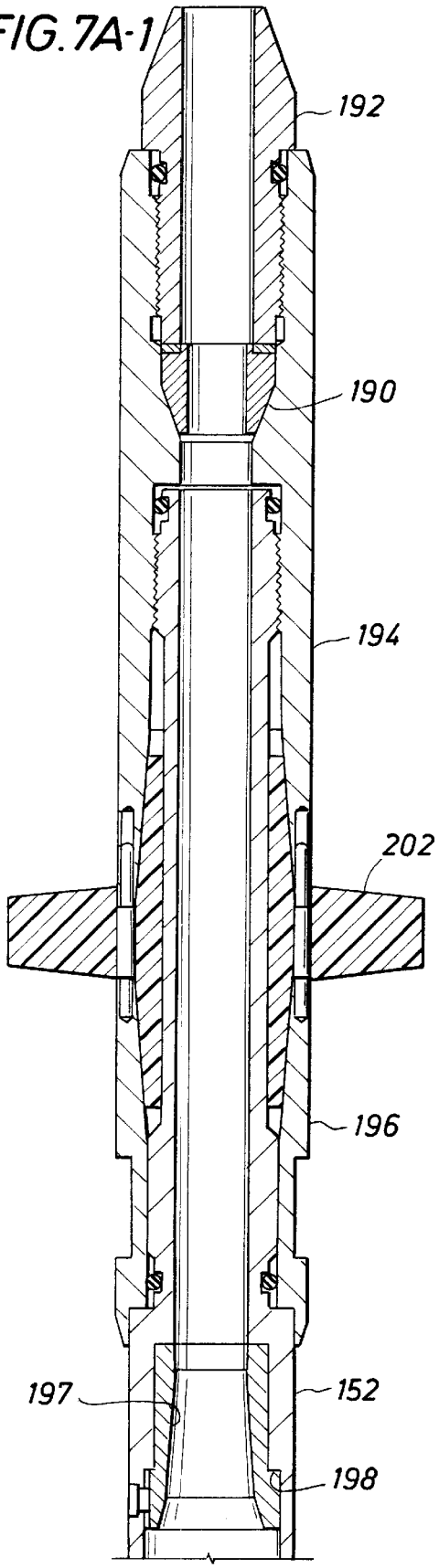
FIGS. 7A–7C illustrate the construction of the cable half portion of the connector (the PWCH) of FIG. 1.
Figures 2, 7A:
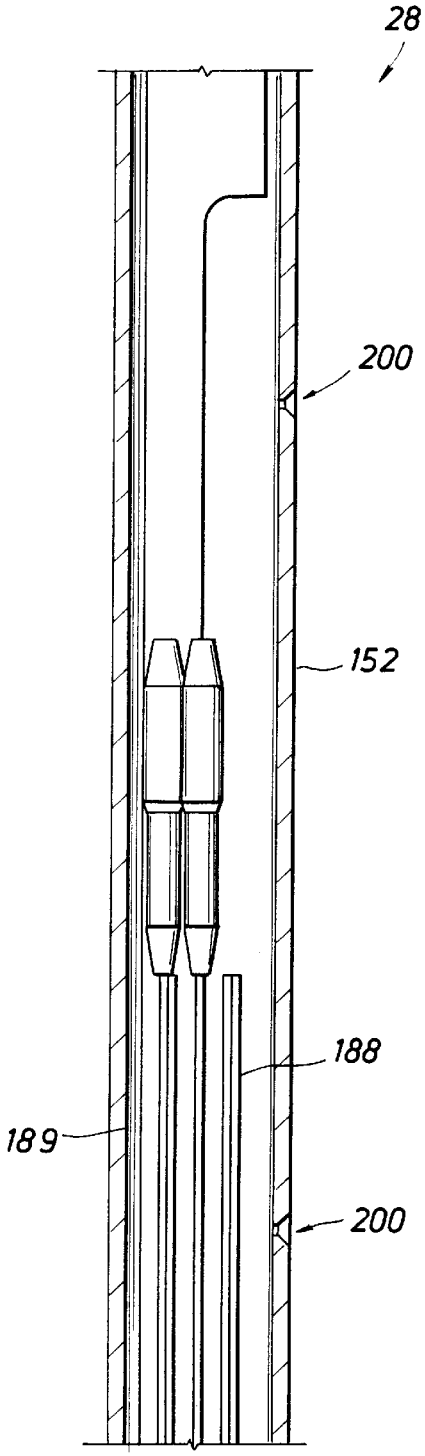
Figure 7B:
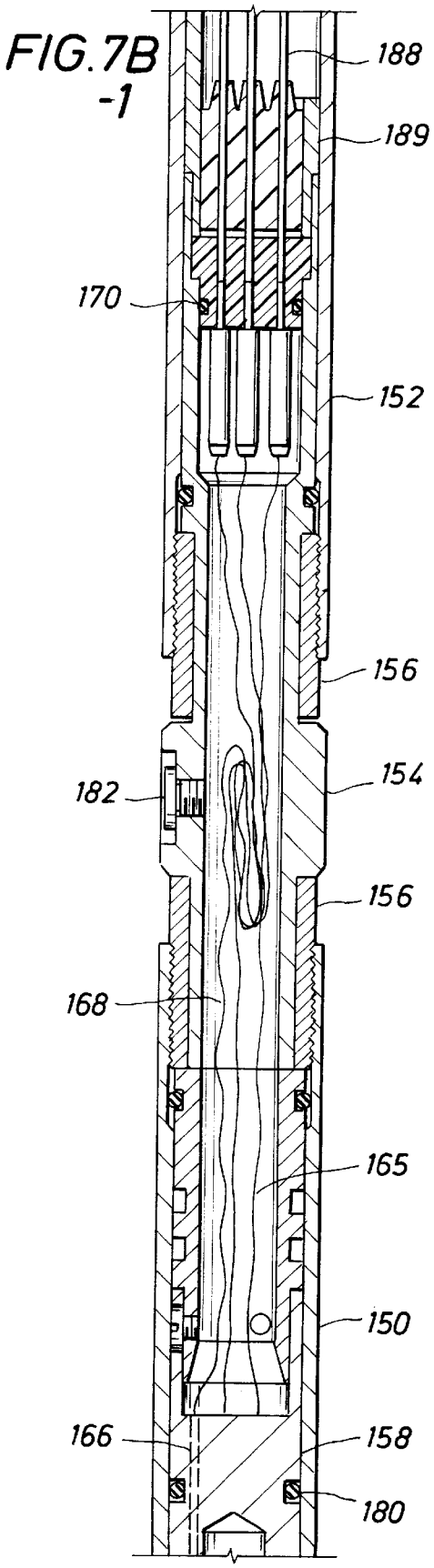
Figure 7B:
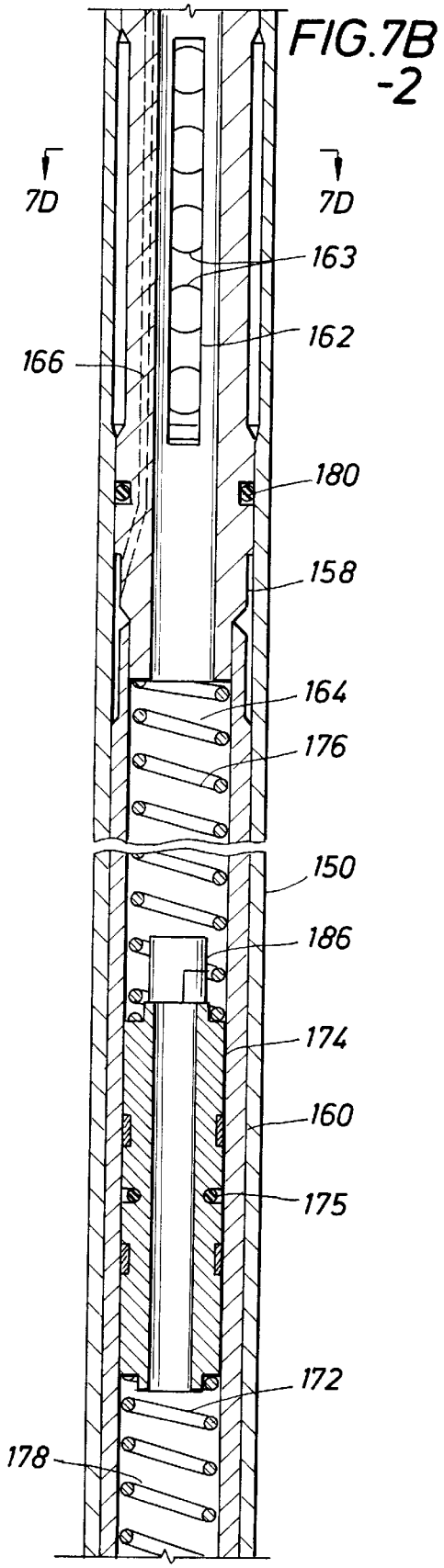
Figures 3, 7B:
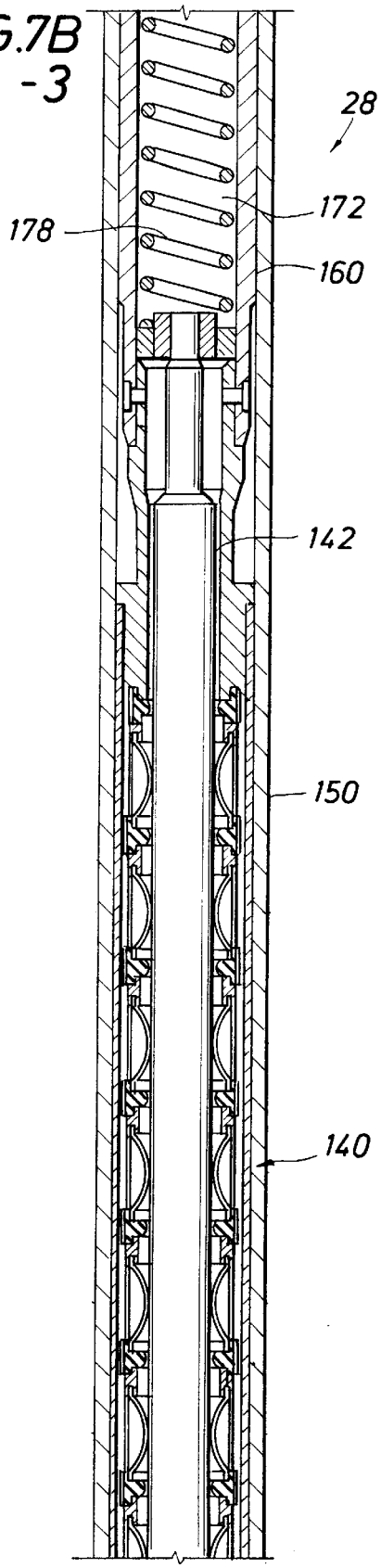
Figure 7C:
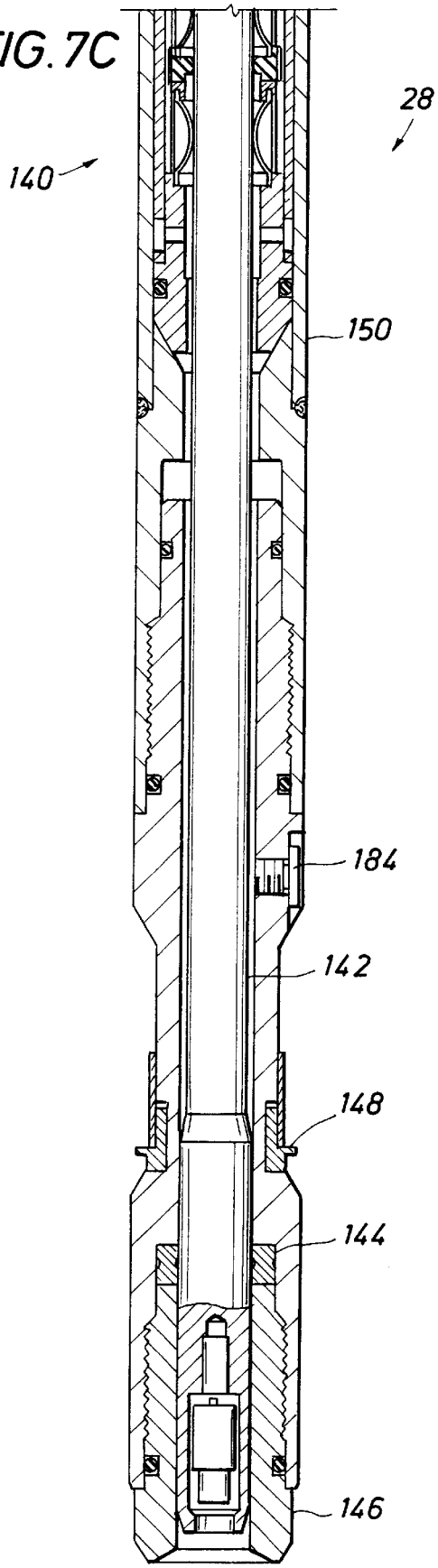

Referring to FIGS. 7A through 7C, PWCH 28 contains a female connector assembly 140 for mating with the male connector assembly 52 of DWCH 22 down hole. As the PWCH is run down the well, before engaging the DWCH, a shuttle 142 of an electrically insulating material is biased to the lower end of the PWCH. A quad-ring seal 144 seals against the outer diameter of shuttle 142 to keep well fluids out of the PWCH until the shuttle is displaced by the male connector assembly of the DWCH. A tapered bottom nose 146 helps to align the PWCH for docking with the PWCH.

When pushed into the DWCH by sufficient inertial or mud pressure loads, the lower end of the PWCH extends through latch fingers 48 of the DWCH (FIG. 6A) until the latch fingers snap behind a frangible latch ring 148 on the PWCH. Once latch ring 148 is engaged by the latch fingers of the DWCH, it resists disengagement of the DWCH and PWCH, e.g., due to drill pipe movement, vibration or u-tubing. Latch ring 148 is selectable from an assortment of rings of different maximum shear load resistances (e.g., 1600 to 4000 pounds, depending on anticipated field conditions) such that the PWCH may be released from the DWCH after data collection by pulling upward on the deployment cable until latch ring 148 shears and releases the PWCH.

The PWCH has an outer housing 150 and a rope socket housing weldment 152 connected by a coupling 154 and appropriate split threaded rings 156. Within outer housing 150 is a wire mandrel sub-assembly with an upper mandrel 158 and a lower mandrel 160. Slots 162 in the upper wire mandrel and holes 163 (FIG. 7D) through the outer housing form an open flow path from the interior of the drill pipe to a mud chamber 164 within the wire mandrel sub-assembly. The signal wires 165 from the female connector assembly 140 are routed between the outer housing 150 and the wire mandrel along axial grooves in the outer surface of lower mandrel 160, through holes 166 in upper mandrel 158, through wire cavity 168, and individually connected to lower pins of connector assembly 170.

Like the DWCH, the PWCH has a pressure compensation system for equalizing the pressure across shuttle 142 while keeping the electrical components surrounded by electrically insulative fluid, such as silicone oil, until the shuttle is displaced. An oil chamber 172 is defined within lower mandrel 160 and separated from mud chamber 164 by a compensation piston 174 with an o-ring seal 175. Piston 174 is free to move within lower mandrel 160, such that the pressure in the mud and oil chambers is substantially equal. Upper and lower springs 176 and 178 are disposed within mud and oil chambers 164 and 172, respectively, and bias shuttle 142 downward. Oil chamber 172 is in fluid communication with wire cavity 168 and the via the wire routing grooves in lower mandrel 160 and wire holes 166 in upper mandrel 158, sealed against drill pipe pressure by seals 180 about the upper mandrel. Therefore, with the shuttle positioned as shown, drill pipe fluid acts against the upper end of compensating piston 174, which transfers pressure to oil chamber 172 and the upper end of shuttle 174, balancing the fluid pressure forces on the shuttle. Fill ports 182 and 184, at upper and lower ends of the oil-filled portion of the PWCH, respectively, allow for filling of oil chamber 172 and wire cavity 168 after assembly. A pressure relief valve 186 in the compensating piston allows the oil chamber to be pressurized at assembly up to 100 psi over the pressure in mud chamber 164 (i.e., atmospheric pressure during assembly).

The upper end of the PWCH provides both a mechanical and an electrical connection to the wireline cable 30 (FIG. 2). Connector assembly 170 has nine electrically isolated pins, each with a corresponding insulated pigtail wire 188 for electrical connection to individual wires of cable 30. A connector retainer 189 is threaded to the exposed end of coupling 154 to hold the connector in place. The specific construction of connector assembly 170 is discussed in more detail below.

To assemble the upper end of the PWCH to the cable, rope socket housing 152 is first threaded over the end of the cable, along with split cable seal 190, seal nut 192, and upper and lower swab cup mandrels 194 and 196, respectively. A standard, self-tightening rope socket cable retainer 197 is placed about the cable end for securing the cable end to the rope socket housing against an internal shoulder 198. The wires of the cable are connected to pigtail wires 188 from the connector assembly, rope socket housing 152 is attached to coupling 154 with a threaded split ring 156, and the rope socket housing is pumped full of electrically insulative grease, such as silicone grease, through grease holes 200. Swab cup 202, discussed in more detail below, is installed between upper and lower swab cup mandrels 194 and 196 to restrict flow through the drill pipe around the PWCH and develop a pressure force for moving the PWCH along the drill pipe and latching the PWCH to the DWCH down hole. Upper swab cup mandrel 194 is threaded onto rope socket housing 152 to hold swab cup 202 in place, and seal nut 192 is tightened.

Figure 8A:
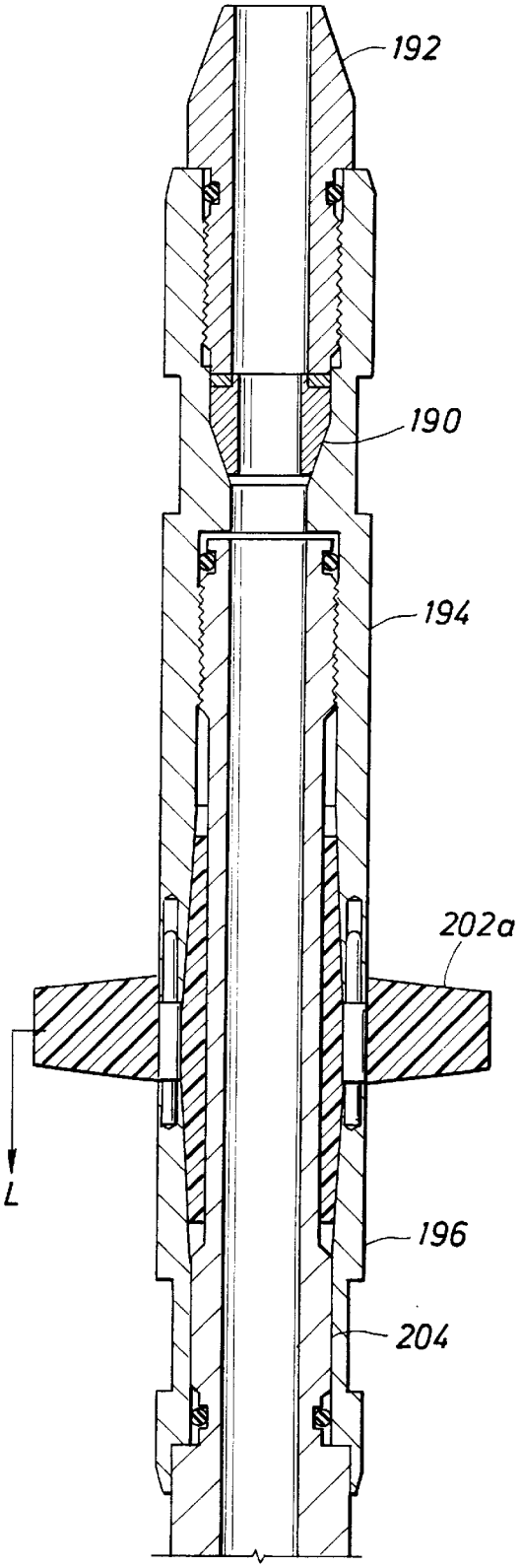
FIG. 8 shows an alternative arrangement of the upper end of the PWCH.
Figure 8B:
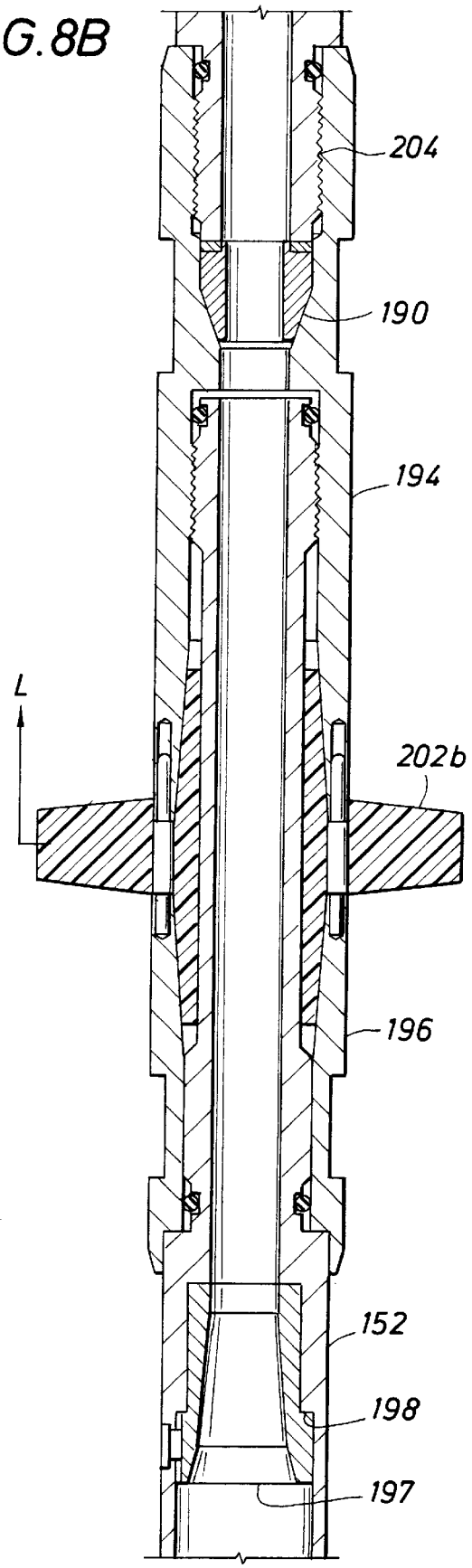

Referring to FIG. 8, an alternate arrangement for the upper end of the PWCH has two swab cups 202*a* and 202*b*, separated by a distance L, for further restricting flow around the PWCH. This arrangement is useful when light, low-viscosity muds are to be used for pumping, for instance. A rope socket housing extension 204 appropriately connects the mandrels of the two swab cups. More than two swab cups may also be used.

Referring to FIG. 9, swab cup 202 creates a flow restriction and a corresponding pressure drop at point A. Because the upstream pressure (e.g., the pressure at point B) is greater than the downstream pressure (e.g., the pressure at point C), a net force is developed on the swab cup to push the swab cup and its attached tool downstream. As shown in FIG. 9A, a swab cup (e.g., swab cup 202*c*) may alternatively be positioned near the bottom of a tool 206 to pull the tool down a pipe or well. This arrangement may be particularly useful, for example, for centering the tool to protect extended features near its downstream end or with large pipe/tool diameter ratios or small tool length/diameter ratios. The desired radial gap $\Delta_r$ between the outer surface of the swab cup and the inner surface of the pipe is a function of several factors, including fluid viscosity. We have found that a radial gap of about 0.05 inch per side (i.e., a diametrical gap of 0.10 inch) works with most common well-drilling muds.

Referring to FIG. 10, swab cup 202 is injection molded of a resilient material such as VITON or other fluorocarbon elastomer, and has a slit 210 down one side to facilitate installation and removal without detaching the cable from the tool. Tapered sections 214 and 216 of the swab cup fit into corresponding bores in the upper and lower swab cup mandrels 194 and 196, respectively, and have outer surfaces that taper at about 7 degrees with respect to the longitudinal axis of the swab cup. The length of the tapered sections helps to retain the swab cup within the bores of the housing. In addition, six pins 217 extend through holes 218 in the swab cup, between the upper and lower swab cup mandrels, to retain the swab cup during use. Circular trim guides 219 are molded into a surface of the swab cup to aid cutting of the cup to different outer diameters to fit various pipe sizes. Other resilient materials can also be used for the swab cup, although ideally the swab cup material should be able to withstand the severe abrasion that can occur along the pipe walls and the great range of chemicals that can be encountered in wells. Other, non-resilient materials that are also useful are soft metals, such as brass or aluminum, or hard plastics, such as polytetrafluoroethylene (TEFLON™) or acetal homopolymer resin (DELRIN™). Non-resilient swab cups can be formed in two overlapping pieces for installation over a pre-assembled tool.

Referring to FIG. 11, female connector assembly 140 of the PWCH has a series of female contacts 220 disposed about a common axis 222. The contacts have a linear spacing d, that corresponds to the spacing of the male contacts of the male connector assembly of the DWCH (FIG. 6A), and a wiper seal 224. Contacts 220 and wiper seals 224 are each held within a corresponding insulator 226. The stack of contacts, wiper seals and insulators in contained within an outer sleeve 228 between an end retainer 230 and an upper mandrel 232.

Referring also to FIGS. 12 and 13, each contact 220 is machined from a single piece of electrically conductive material, such as beryllium copper, and has a sleeve portion 234 with eight (preferably six or more) extending fingers 236. Contact 220 is preferably gold-plated. Fingers 236 are each shaped to bow radially inward, in other words to have, from sleeve portion 234 to a distal end 237, a first portion 238 that extends radially inward and a second portion 240 that extends radially outward, forming a radially innermost portion 242 with a contact length d, of about 0.150 inch. By machining contact 220 from a single piece of stock, fingers 236, in their relaxed state as shown, have no residual bending stresses that tend to reduce their fatigue resistance.

The inner diameter $d_1$ of contact 220, as measured between contact surfaces 242 of opposite fingers, is slightly smaller than the outer diameter of male electrical contacts 102 of the DWCH (FIG. 6A), such that fingers 236 are pushed outward during engagement with the male connector and provide a contact pressure between contact surfaces 242 and male contacts 102. The circumferential width, w, of each finger tapers to a minimum at contact surface 242. We have found that machining the contact such that the length $d_c$ of contact surfaces 242 is about one-fourth of the overall length $d_f$ of the fingers, and the radial thickness, t, of the fingers is about 75 percent of the radial distance, r, between the inner surface of sleeve portion 234 and contact surfaces 242, results in a contact construction that withstands repeated engagements.

Wiper seals 224 are preferably molded from a resilient fluorocarbon elastomer, such as VITON™. The inner diameter $d_2$ of wiper seals 224 is also slightly smaller than the outer diameter of the male contacts, such that the wiper seals tend to wipe debris from the male contact surface during engagement. Preferably, the inner diameters $d_1$ and $d_2$ of the contacts and wiper seals are about equal. Wiper seals 224 are molded from an electrically insulative material to reduce the possibility of shorting between contacts in the presence of electrically conductive fluids.

Contact 220 has a solder lug 244 machined on one side of its sleeve portion 234 for electrically connecting a wire 246. As shown in FIG. 12, as wired contact 220 is inserted into insulator 226, wire 246 is routed through a hole 248 in the insulator. Alignment pins 250 in other holes 248 in the insulator fit into external grooves 252 of wiper seal 224 to align the wiper seal to the insulator. A notch 254 on the wiper seal fits around solder lug 244. Insulators 226 and wiper seals 224 are formed with sufficient holes 248 and grooves 252, respectively, to route all of the wires 246 from each of contacts 220 in the female connector to the upper end of the assembly for attachment to seal assembly 170 (FIG. 7B).

With contact 220 inserted into insulator 226, the distal ends 237 of the contact fingers lie within an axial groove 256 formed by an inner lip 258 of the insulator. Lip 258 protects the distal ends of the fingers from being caught on male connector assembly surfaces during disengagement of the PWCH from the DWCH.

Figure 14:
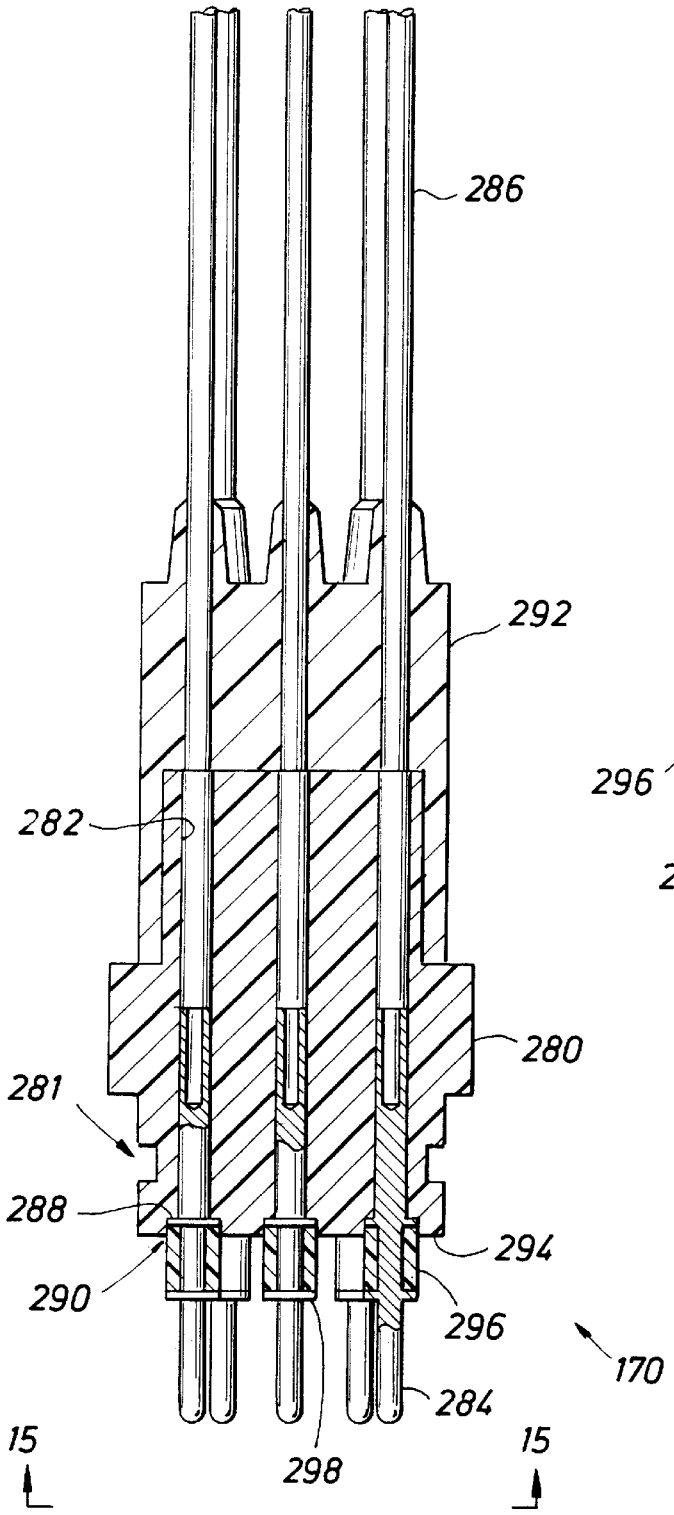
FIG. 14 is an enlarged view of the multi-pin connector of FIG. 7B.

Referring to FIG. 14, connector assembly 170 of the PWCH has a molded connector body 280 of an electrically insulative material, such as polyethylketone, polyethyletherketone or polyaryletherketone. Body 280 is designed to withstand a high static differential pressure of up to, for instance, 15,000 psi across an o-ring in o-ring groove 281, and has through holes 282 into which are pressed electrically conductive pins 284 attached to lead wires 286. (Lead wires 286 form pigtail wires 188 of FIG. 7B.) Gold-plated pins 284 of 17-4 stainless steel are pressed into place until their lower flanges 288 rest against the bottoms of counterbores 290 in the connector body. To seal the interface between the connector body and the lead wires, a wire seal 292 is molded in place about the wires and the connector body after the insulation on the individual lead wires has been etched for better adhesion to the seal material. Seal 292 must also withstand the high differential pressures of up to 15,000 psi experienced by the connector assembly. We have found that some high temperature fluorocarbon elastomers, such as VITON™ and KALREZ™, work well for wire seal 292.

To form an arc barrier between adjacent pins 284, and between the pins and coupling 154 (FIG. 7B), at face 294 of connector body 280, individual pin insulators 296 are molded in place about each of pins 284 between their lower and upper flanges 288 and 298, respectively. Insulators 296 extend out through the plane of face 294 of the connector body about 0.120 inch, and are preferably molded of a high temperature fluorocarbon elastomer such as VITONT™ or KALREZ™. Insulators 296 guard against arcing that may occur along face 294 of the connector body if, for instance, moist air or liquid water infiltrates wire cavity 168 of the PWCH (FIG. 7B). Besides guarding against undesired electrical arcing, insulators 296 also help to seal out moisture from the connection between pins 284 and lead wires 286 inside the connector body during storage and transportation.

Figure 15:
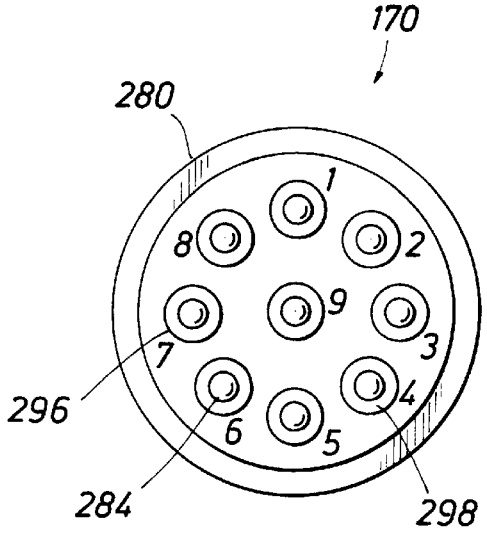
FIG. 15 is an end view of the connector, as viewed from direction 15 in FIG. 14.

Referring also to FIG. 15, connector body 280 has an outer diameter $d_b$ of about 0.95 inches in order to fit within the small tool inner diameters (of down to 1.0 inch, for example) typical of down hole instrumentation. The assembled connector has a circular array of nine pins 284, each with corresponding insulators 296 and lead wires 286.

What is claimed is:

1. A bulkhead adaptor for use with a downhole tool to be pumped through a well casing or drill pipe on a cable, comprising a housing assembly having an upper housing section with an upper attachment element for connecting the housing assembly to the cable, and a lower housing section constructed for releasable attachment to the upper housing section and having a lower attachment element for connecting the housing to the tool; and a circular swab cup comprising a resilient material compressed between the upper and lower housing sections and defining a surface area exposed to a flow of pumping fluid, the swab cup being removably attached to the housing and having an outer diameter enclosing a projected area greater than the projected area of the tool, measured in a plane transverse to said well casing or drill pipe.

2. The adaptor of claim 1 wherein the resilient material comprises a fluorocarbon elastomer.

3. The adaptor of claim 1 wherein the swab cup comprises a material selected from the group consisting of aluminum, brass, polytetrafluoroethylene and acetal resin.

4. The adaptor of claim 1 wherein the resilient material comprises an acetal homopolymer resin.

5. The adaptor of claim 1 wherein the housing further comprises a swab cup retainer pin extending between the upper and lower housing sections, through the swab cup.

6. The adaptor of claim 1 wherein the lower housing section comprises a lower body defining a shoulder and having a shaft extending from the shoulder through the swab cup, the shaft having a threaded end portion, and a lower swab cup retainer sleeve rotatably disposed about the shaft between the shoulder and the swab cup; and the upper housing section comprises a nut with threads for engaging the threaded end portion of the shaft in a manner to compress the swab cup, and an upper swab cup retainer sleeve rotatably disposed about the shaft between the nut and the swab cup.

7. The adaptor of claim 1 wherein at least one of the upper and lower housing sections defines an inner bore axially overlapping an outer surface of the swab cup in a manner to retain the swab cup.

8. The adaptor of claim 7 wherein said inner bore defines a frustoconical surface with a taper angle, measured with respect to the axis of the swab cup, of between about 5 and 10 degrees.

9. The adaptor of claim 1 wherein the swab cup comprises an injection-molded material.

10. The adaptor of claim 9 wherein the swab cup defines concentric, molded trim guides indicating trimming diameters for adapting the swab cup for use in different well casing or drill pipe diameters.

11. The adaptor of claim 1 wherein the housing defines an inner bore for extending the cable through the adaptor for electrical connection to the tool.

12. The adaptor of claim 11 wherein the upper attachment comprises a grommet for sealing between the cable and the housing, and a grommet nut for compressing the grommet about the cable.

13. The adaptor of claim 12 wherein the grommet defines a slit extending through one side of the grommet, such that the grommet is replaceable without separating the cable from the housing.

14. In combination, the adaptor of claim 1 and a well logging tool attached to the lower attachment of the adaptor housing.

15. The adaptor of claim 1 wherein the swab cup defines a slit extending radially outward down one side thereof, for installation and removal of the swab cup with the cable attached to the tool.

16. A downhole tool to be pumped through a well casing or drill pipe on a cable, comprising a circular swab cup of a resilient, injection molded material and attached to the tool near its lower end, the swab cup defining a surface area exposed to a flow of pumping fluid, the swab cup being removably attached to the tool and having an outer diameter enclosing a projected area greater than the projected area of the tool, measured in a plane transverse to said well casing or drill pipe.

17. A method of pumping a tool through a well casing or drill pipe on a cable, comprising providing a swab cup adaptor comprising a housing assembly having an upper attachment element for connecting the housing assembly to the cable, and a lower attachment element for connecting the housing to the tool, and a circular swab cup comprising an injection molded resilient material and defining a surface area exposed to a flow of pumping fluid, the swab cup being removably attached to the housing and having an outer diameter enclosing a projected area greater than the projected area of the tool, measured in a plane transverse to said well casing or drill pipe;

attaching the tool to the lower attachment of the swab cup adaptor;

attaching the cable to the upper attachment of the swab cup adaptor;

placing the tool and swab cup adaptor in said well casing or drill pipe; and pumping fluid through the well casing to push the swab cup adaptor and the attached tool through said well casing or drill pipe.

18. The method of claim 17 further comprising the step of trimming the swab cup adaptor to a diameter appropriate to the diameter of said well casing or drill pipe.

19. The method of claim 18 wherein the swab cup is trimmed to an outer diameter about 0.10 inch less than the diameter of said well casing or drill pipe.

20. A bulkhead adaptor for too with a downhole tool to be pumped through a well casing or drill pipe on a cable, comprising a housing assembly having a lower housing section with a lower attachment element for connecting the housing to the tool, an upper housing section constructed for releasable attachment to the lower housing section and having an upper attachment element for connecting the housing assembly to the cable, and a swab cup retainer pin extending between the upper and lower housing sections; and a circular swab cup defining a surface area exposed to a flow of pumping fluid, the swab cup being removably attached to the housing and retained between the upper and lower housing sections and having an outer diameter enclosing a projected area greater than the projected area of the tool, measured in a plane transverse to said well casing or drill pipe, the swab cup comprising a resilient material compressed between the upper and lower housing sections, with the swab cup retainer pin extending through the swab cup.

21. A bulkhead adaptor for use with a downhole tool to be pumped through a well casing or drill pipe on a cable, comprising a housing assembly having a lower housing section with a lower attachment element for connecting the housing to the tool, the lower housing section comprising a lower body defining a shoulder and having a shaft extending from the shoulder and having a threaded end portion, and a lower swab cup retainer sleeve rotatably disposed about the shaft; and an upper housing section constructed for releasable attachment to the lower housing section and having an upper attachment element for connecting the housing assembly to the cable, the upper housing section comprising a nut with threads for engaging the threaded end portion of the lower swab cup shaft, and an upper swab cup retainer sleeve rotatably disposed about the shaft; and a circular swab cup comprising a resilient material compressed between the upper and lower housing sections with the lower body shaft extending therethrough, the lower swab cup retainer sleeve disposed between the shoulder and the swab cup, and the upper swab cup retainer sleeve disposed between the nut and the swab cup, the swab cup defining a surface area exposed to a flow of pumping fluid, the swab cup being removably attached to the housing and having an outer diameter enclosing a projected area greater than the projected area of the tool, measured in a plane transverse to said well casing or drill pipe.

22. A bulkhead adaptor for use with a downhole tool to be pumped through a well casing or drill pipe on a cable, comprising a housing assembly having a lower housing section with a lower attachment element for connecting the housing to the tool, and an upper housing section constructed for releasable attachment to the lower housing section and having an upper attachment element for connecting the housing assembly to the cable; and a circular swab cup comprising a resilient material compressed between the upper and lower housing sections, at least one of the upper and lower housing sections defining an inner bore axially overlapping an outer surface of the swab cup in a manner to retain the swab cup, the swab cup defining a surface area exposed to a flow of pumping fluid, the swab cup being removably attached to the housing and retained between the upper and lower housing sections and having an outer diameter enclosing a projected area greater than the projected area of the tool, measured in a plane transverse to said well casing or drill pipe.

23. A bulkhead adaptor for use with a downhole tool to be pumped through a well casing or drill pipe on a cable, comprising a housing assembly having an upper attachment element for connecting the housing assembly to the cable, and a lower attachment element for connecting the housing to the tool; and a circular swab cup comprising a resilient, injection-molded material and defining a surface area exposed to a flow of pumping fluid, the swab cup being removably attached to the housing and having an outer diameter enclosing a projected area greater than the projected area of the tool, measured in a plane transverse to said well casing or drill pipe.

24. A bulkhead adaptor for use with a downhole tool to be pumped through a well casing or drill pipe on a cable, comprising a housing assembly defining an inner bore for extending the cable through the adaptor for electrical connection to the tool, the housing assembly comprising an upper attachment element for connecting the housing assembly to the cable, and a lower attachment element for connecting the housing to the tool; and a circular swab cup defining a surface area exposed to a flow of pumping fluid, the swab cup being removably attached to the housing and having an outer diameter enclosing a projected area greater than the projected area of the tool, measured in a plane transverse to said well casing or drill pipe.

25. In combination, a bulkhead adaptor for use with a downhole tool to be pumped through a well casing or drill pipe on a cable, comprising a housing assembly having an upper attachment element for connecting the housing assembly to the cable, and a lower attachment element for connecting the housing to the tool; and a circular swab cup defining a surface area exposed to a flow of pumping fluid, the swab cup being removably attached to the housing and having an outer diameter enclosing a projected area greater than the projected area of the tool, measured in a plane transverse to said well casing or drill pipe; and a well logging tool attached to the lower attachment of the adaptor housing.

26. A method of pumping a tool through a well casing or drill pipe on a cable, comprising providing a swab cup adaptor comprising a housing assembly having an upper attachment element for connecting the housing assembly to the cable, and a lower attachment element for connecting the housing to the tool, and a circular swab cup defining a surface area exposed to a flow of pumping fluid, the swab cup being removably attached to the housing and having an outer diameter enclosing a projected area greater than the projected area of the tool, measured in a plane transverse to said well casing or drill pipe;

attaching the tool to the lower attachment of the swab cup adaptor;

attaching the cable to the upper attachment of the swab cup adaptor;

trimming the swab cup adaptor to a diameter appropriate to the diameter of said well casing or drill pipe;

placing the tool and swab cup adaptor in said well casing or drill pipe; and pumping fluid through the well casing to push the swab cup adaptor and the attached tool through said well casing or drill pipe.

* * * * *